US006772839B1

(12) United States Patent
Bond

(10) Patent No.: US 6,772,839 B1
(45) Date of Patent: Aug. 10, 2004

(54) METHOD AND APPARATUS FOR MECHANICALLY PERFORATING A WELL CASING OR OTHER TUBULAR STRUCTURE FOR TESTING, STIMULATION OR OTHER REMEDIAL OPERATIONS

(75) Inventor: Lesley O. Bond, 707 Peterson Rd., Neosho, MO (US) 64850

(73) Assignee: Lesley O. Bond, Neosho, MO (US)

( * ) Notice: Subject to any disclaimer, the term of this patent is extended or adjusted under 35 U.S.C. 154(b) by 0 days.

(21) Appl. No.: 10/047,796

(22) Filed: Oct. 22, 2001

(51) Int. Cl.[7] ..... E21B 29/00

(52) U.S. Cl. ..... 166/298; 166/383; 166/55; 166/100

(58) Field of Search ..... 166/297, 298, 166/383, 387, 55, 55.2, 55.8, 100

(56) References Cited

U.S. PATENT DOCUMENTS

| | | | | | |
|---|---|---|---|---|---|
| 2,306,670 | A | * | 12/1942 | Sutliff | 166/55.2 |
| 2,381,929 | A | * | 8/1945 | Schlumberger | 166/55.1 |
| 3,346,049 | A | * | 10/1967 | Brown | 166/286 |
| 4,119,148 | A | * | 10/1978 | Deardorf | 166/250.01 |
| 4,658,916 | A | | 4/1987 | Bond | |
| 4,709,384 | A | * | 11/1987 | Schiller | 378/76 |
| 4,765,173 | A | * | 8/1988 | Schellstede | 72/325 |
| 4,932,129 | A | * | 6/1990 | Schellstede et al. | 30/358 |
| 5,183,111 | A | * | 2/1993 | Schellstede | 166/298 |
| 5,327,970 | A | * | 7/1994 | McQueen et al. | 166/278 |
| 5,392,858 | A | * | 2/1995 | Peters et al. | 166/298 |
| 5,701,958 | A | * | 12/1997 | Braziel | 166/298 |
| 6,167,968 | B1 | * | 1/2001 | Allarie et al. | 166/298 |

* cited by examiner

*Primary Examiner*—David Bagnell
*Assistant Examiner*—Daniel Stephenson
(74) *Attorney, Agent, or Firm*—Mary M. Lee

(57) ABSTRACT

An apparatus and method for perforating, testing, squeezing and/or stimulating an oil or gas well, or other tubular structure. The apparatus preferably is suspended from an elongate conduit, such as a drill string or tubing. The apparatus is secured in position by a retractable back-up plate, and then a piercing member perforates the casing. A first valve controls the flow of fluid from a high-pressure accumulator to drive the various pistons in the apparatus. A second valve directs fluid from the elongate conduit either to exit through the perforation or to exit the housing and return up the conduit. Axial movement of the elongate conduit controls both valves in the apparatus. Upon completion of the operation, the piercing member is advanced to plug the perforation, the back-up plate is retracted, and the apparatus is removed.

50 Claims, 12 Drawing Sheets

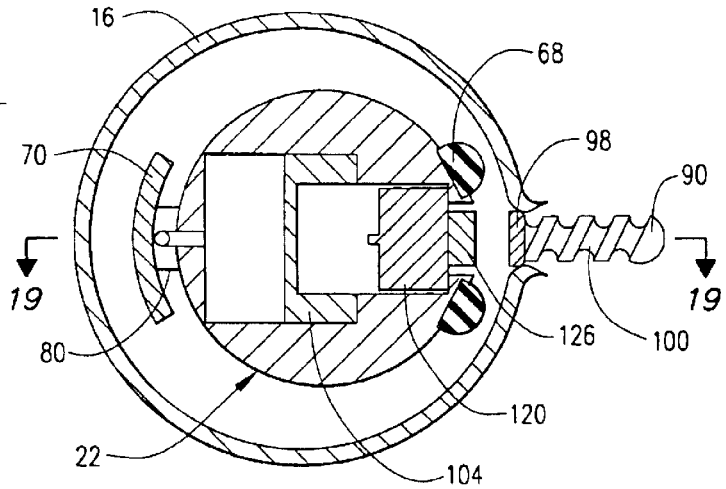
FIG. 16
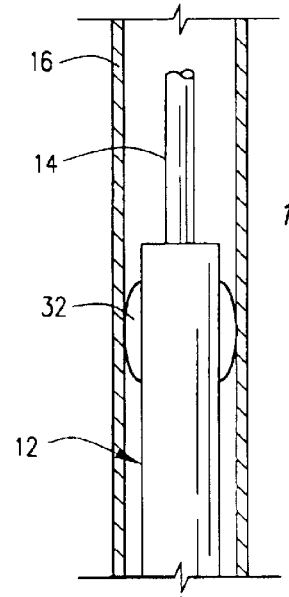
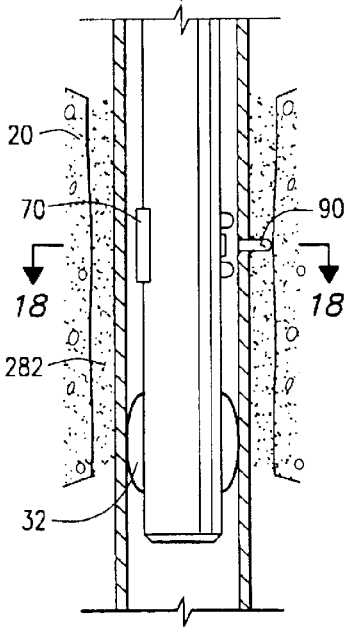
FIG. 17
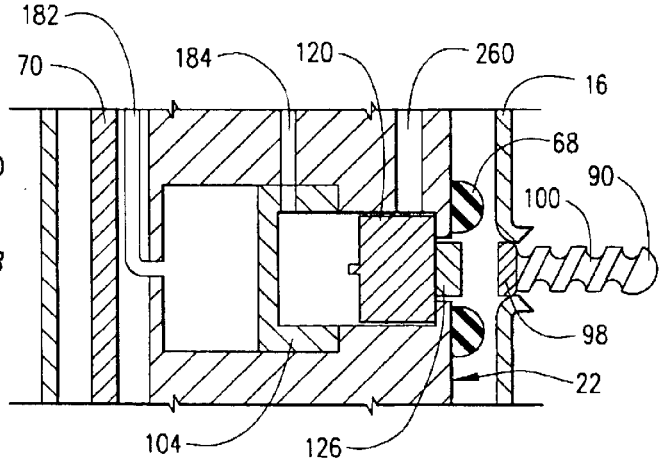
FIG. 18

METHOD AND APPARATUS FOR MECHANICALLY PERFORATING A WELL CASING OR OTHER TUBULAR STRUCTURE FOR TESTING, STIMULATION OR OTHER REMEDIAL OPERATIONS

FIELD OF THE INVENTION

The present invention relates generally to devices and methods for perforating tubular structures and, more particularly but without limitation, to devices and methods for perforating well casings in subterranean wells to perform remedial operations such as testing and stimulation.

BACKGROUND OF THE INVENTION

In the management of oil and gas wells, many procedures involve the movement of fluid or flowable material into or from a formation. During the drilling and production phases of a well, a testing procedure may be conducted to recover a sample of fluid from behind the casing to determine the quality or content of the fluid in the formation. Sometimes it is necessary to inject treatment fluids, such as acids, to stimulate or initiate production.

In one procedure called "squeezing," cement is injected into the annulus around the outside of the casing to isolate a formation. This multi-operation procedure involves installing a bridge plug below the target area, perforating the casing, setting a squeeze tool above the target formation, and then pumping cement through the squeeze tool using a stinger. Thus, the conventional squeezing operation results in a short section of casing being left filled with cement, as well as the bridge plug and squeeze tool. All of this must then be cleared by re-drilling to reopen the well for production. In addition to being time-consuming and expensive, this conventional squeezing procedure is often ineffective.

In all of these procedures, the casing must be perforated and a flow path established between the surface and the perforation. The present invention provides a system, apparatus and method for perforating the well casing, establishing the fluid flow path from the perforation to the surface, and then plugging the perforation upon completion, all in one downhole operation which leaves the well casing unobstructed. However, the apparatus, system and method of this invention are versatile and have applications outside the oil and gas industry in tubular structures of various kinds.

SUMMARY OF THE INVENTION

The present invention is directed to an apparatus for perforating a tubular structure. The apparatus comprises a housing having a first end defining an inlet. The housing is supportable at a selected position in the tubular structure and defines an operating fluid flow path beginning with the inlet. Also included is a perforating assembly in the housing. The perforating assembly comprises a piercing member supported for movement from a first position within the housing to a second position in which a portion of the piercing member is extendable through the tubular structure. In addition, the piercing member comprises a fluid flow path. The perforating assembly defines a fluid flow path continuous with the operating fluid flow path through the housing and the fluid flow path in the piercing member. In this way, when the piercing member is in the second position, a continuous flow path is formed between the inlet of the housing and the portion of the piercing member that this extendable through the tubular structure. The apparatus also includes a control assembly adapted to control movement of the piercing member.

The present invention further comprises a perforating system for perforating the casing in a subterranean well. The system comprises a rotatable and axially movable elongate conduit sized to be received in the casing. The conduit has an end extendable into the casing. The system includes a perforating apparatus comprising a housing supportable at a selected position in the tubular structure. The housing has a first end defining an inlet, and the first end is connectable to the end of the conduit so that the conduit is continuous with the inlet. The housing defines an operating fluid flow path beginning with the inlet. The system includes a perforating assembly in the housing. The perforating assembly includes a piercing member supported for movement from a first position within the housing to a second position in which a portion of the piercing member is extendable beyond the housing to perforate the well casing. The piercing member comprises a fluid flow path. The perforating assembly defines a fluid flow path. continuous with the operating fluid flow path through the housing and the fluid flow path in the piercing member. Thus, when the piercing member is in the second position, a continuous flow path is formed between the conduit and the portion of the piercing member that is extendable through the well casing. A control assembly, adapted to control movement of the piercing member, is also included in this apparatus.

Still further, the present invention includes a valve for directing fluid from a source of pressurized fluid to one of a plurality of fluid-operated devices. The valve comprises a valve body having a tubular sidewall defining a longitudinal throughbore. The sidewall comprises a first inlet fluidly connectable to the fluid source, and a plurality of longitudinally spaced-apart outlets. Each of the plurality of outlets is connectable to a different one of the fluid-operated devices. A sleeve is sealingly slidable inside the throughbore of the valve body. The sleeve comprises an outer wall, an inner wall, and an annular space therebetween. A fluid inlet in the outer wall is in fluid communication with the annular space. Also, a plurality of outlets in the outer wall are in fluid communication with the annular space. Each one of the plurality of outlets corresponds to a respective one of the plurality of outlets in the valve body. The sleeve is axially movable from a closed position, in which none of the outlets in the sleeve is aligned with its corresponding outlet in the body, to a plurality of valving positions in which the inlet in the sleeve is aligned with the inlet in the valve body and in which one of the plurality of outlets in the valve body is aligned with the corresponding outlet in the sleeve. Thus, in each of the valving positions, fluid from fluid source is directed to the respective one of the fluid-operated devices.

In yet another aspect, the present invention is directed to a method for establishing a fluid flow path between one end of a tubular structure and a selected area outside the tubular structure a distance from the end. This method comprises perforating the tubular structure at a position near the selected area, and then flowing flowable material between the end of the tubular structure and the selected area outside the tubular structure without leaving a significant amount of the fluid inside the tubular structure.

In still another aspect, the present invention comprises an apparatus for perforating a tubular structure. The apparatus includes a housing having an inlet and an outlet. A fluid-driven piercing member is supported for movement from a first position within the housing to a second position in which a portion of the piercing member is extendable through the tubular structure. The piercing member comprises a fluid flow path. The housing defines an operating fluid flow path beginning with the inlet and connectable alternately with the fluid flow path in the piercing member and the outlet of the housing. A pressurized fluid reservoir is included, and is fluidly connected to the fluid driven piercing member. A first valve is adapted to control flow of fluid between the high-pressure fluid reservoir and the piercing member to drive the movement of the piercing member from the first position to the second position. A second valve is adapted to control flow of fluid between the operating flow path in the housing and to either of the flow path in the piercing member and the outlet of the housing.

Still further, the invention includes an apparatus for perforating a tubular structure. The apparatus comprises a housing, and a piercing member supported in the housing for movement from a first position to a second position in which a portion of the piercing member is extendable through the tubular structure. Also included is a fluid driven setting/pack-off assembly adapted to secure the apparatus temporarily at a selected position in the tubular structure. The setting/pack-off assembly comprises a back-up plate sized to engage the tubular structure. The back-up plate is movable in a first direction from a retracted position in which the back-up plate does not engage the tubular structure to an extended position in which the back-up plate engages the tubular structure. The back-up plate is also movable in a second direction from the extended position to the retracted position. The apparatus includes a pressurized fluid reservoir fluidly connected to the setting/pack-off assembly, and a valve adapted to control the flow of fluid from the fluid reservoir to the setting/pack-off assembly.

BRIEF DESCRIPTION OF THE DRAWINGS

FIG. 17 is a partially sectional view of a well showing the apparatus as it is destabilized for removal from the well while leaving the hole plugged.

FIG. 18 is a cross-sectional view taken along line 18—18 of FIG. 17.

FIG. 19 is a longitudinal sectional view taken along FIG. 19—19 of FIG. 18.

DETAILED DESCRIPTION OF THE PREFERRED EMBODIMENT

In accordance with the present invention, an apparatus, system and method are provided to perforate well casings, and other tubular structures, for well testing, stimulation and other remedial operations. As used herein, "tubular structure" means any elongate, hollow tubular structure as well as a bore hole, such as an uncased well bore. This includes but is not limited to the casings in oil wells, gas wells, water wells and any other form of subterranean well. Moreover, as used herein, "tubular structure" includes both vertical and horizontal structures and all cross-sectional shapes, including but not limited to round, square, and hexagonal.

Figure 1:
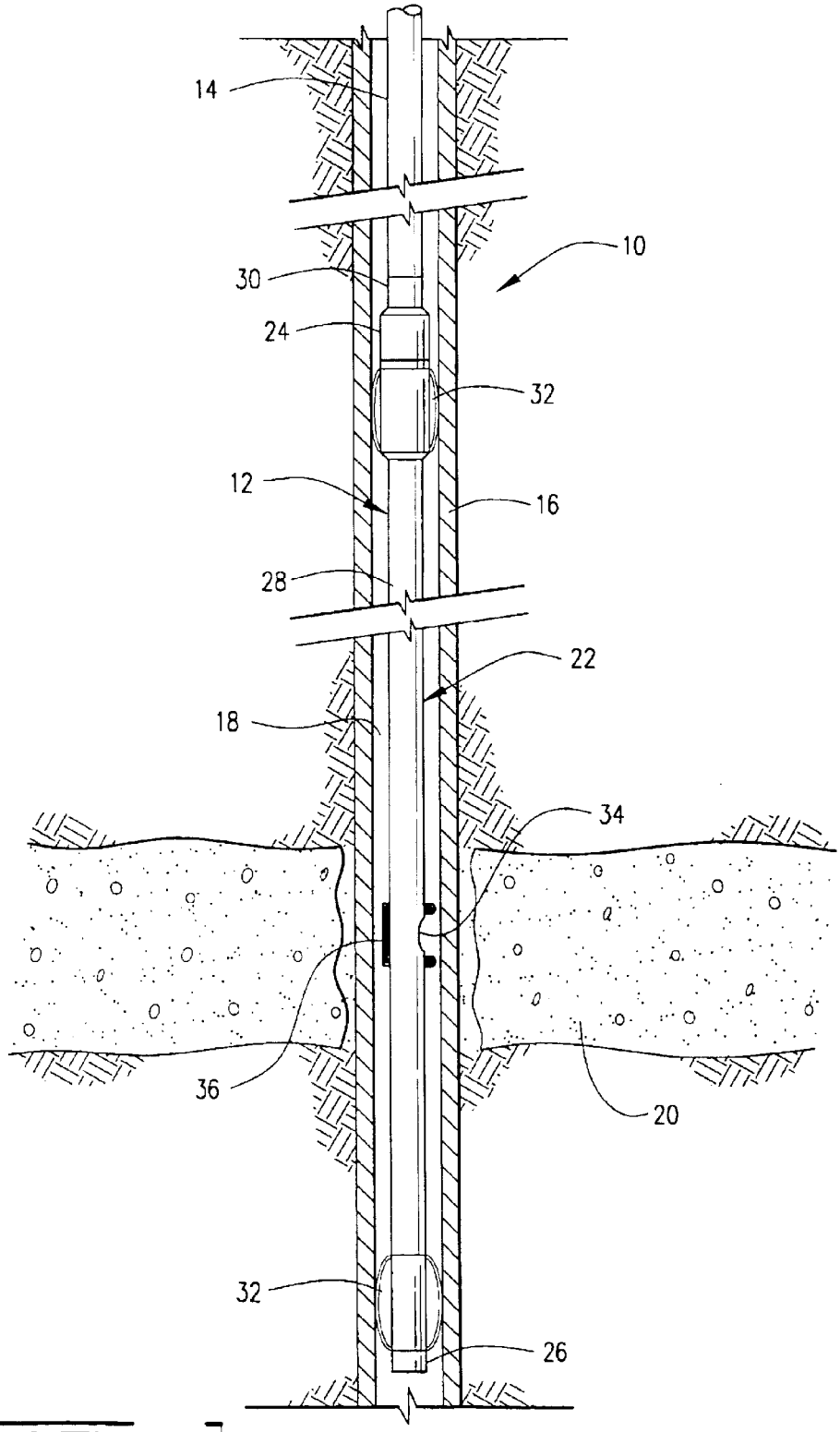
FIG. 1 shows a side elevational, partially sectional, fragmented view of an oil well illustrating a system with an apparatus in accordance with the present invention. The apparatus is shown suspended from a drill string in a subterranean well adjacent a formation.

With reference now to the drawings in general and to FIG. 1 in particular there is shown therein a system constructed in accordance with present invention and designated generally by the reference numeral 10. The system 10 comprises an apparatus 12 shown suspended from a drill string 14 in the casing 16 of an oil well 18. The apparatus 12 is shown positioned at the level of a formation 20.

Generally, in its preferred form, the apparatus 12 comprises an elongate housing 22, preferably cylindrical, with a first end 24 and a second end 26 and a sidewall 28. The first end 24 is connectable in some fashion to the drill string 14 or other elongate conduit. Preferably, the connection between the drill string 14 and the housing 22 comprising a releasable lock assembly 30 to be described in more detail hereafter.

In most instances, it will advantageous to provide one or more friction members sized to provide frictional engagement with the inside of the casing 16. In this way, the apparatus 12 can be positioned in the well by pushing on the drill string and removed from the well by pulling on the drill string, but it will not drop freely down the casing. A variety of devices are available for this purposes; bow spring centralizers 32 are used in the preferred embodiment. As shown, one centralizer 32 is positioned near each end of the housing 22.

A perforating assembly 34 is supported in the housing 22, and will be described hereafter with particularity. As illustrated only generally in FIG. 1, the perforating assembly 34 is positioned along the length of the housing 22 preferably between the centralizers 32.

Referring still to FIG. 1, the apparatus 12 is supportable at a selected position in the casing 16 adjacent the target formation 20. While the centralizers 32 or other friction members serve to maintain the position of the housing 22 to some extent, stabilization is usually desirable. For that purpose, a setting/pack-off assembly 36 may be included. Ideally, the setting/pack-off assembly 36 is positioned to provide a force opposing the force of the perforating assembly 34. A preferred setting/pack-off assembly 36 is described below in detail.

Turning now to FIGS. 2A–2E, the preferred design for the apparatus 12 will be described in more detail. As indicated, the housing 22 is connectable to an elongate support member, preferably an elongate conduit, such as a drill string 14.

As will be explained later, axial movement of the drill string 14 is used to operate the setting/pack-off assembly 36 and the perforating assembly 34 in the apparatus 12. Yet, during positioning of the apparatus 12 in the well casing 16, it is advantageous for the drill string 14 to be rigidly connected to the housing 22. This feature is provided incorporating a releasable lock assembly into the apparatus 10. A preferred releasable lock assembly 30 is shown in more detail in FIG. 2A. A similar releasable locking device is shown and described in U.S. Pat. No. 4,658,916 entitled Method and Apparatus for Hydrocarbon Recovery, the contents of which are incorporated herein by reference.

The preferred lock assembly 30 comprises a first or inner collar member 38 comprising a body 40 with a first end 42 and a second end 44. The first end 42 is attachable, such as by a threaded connection, to the end of the drill string 14. The lock assembly 30 further comprises a second or outer collar 46 comprising a body 48 with a first end 50 and a second end 52 that is fluted or split longitudinally into fingers 54. The housing 22 of the apparatus 12 is connectable to the outer collar 46, such as by a threaded connection on the body 48. The outer collar 46 is releasably engagable with the inner collar 38 by the inner teeth 56 that engage the threads 58 on body 40 of the inner collar 38. Thus, the inner collar 38 can be disengaged from the outer collar 46 by rotating the drill string 14 clockwise while "slacking off" a few pounds weight. The inner collar 38 can be reset by pulling up on the drill string 14 to cause the fingers 54 to spread slightly and allow the teeth 56 to slip back down over the threads 58 of the inner collar 38.

In some instances, the apparatus of this invention may be used with coiled tubing instead of a drill string. Because coiled tubing cannot be rotated, it would be necessary to substitute for the above-described lock assembly 30 a lock assembly that is operable without rotation of the conduit. One such lock assembly is a hydraulic system activated by dropping a ball down the tubing to close a port and permit use of hydraulic pressure from the surface to engage and disengage the lock mechanism.

Figure 2A:
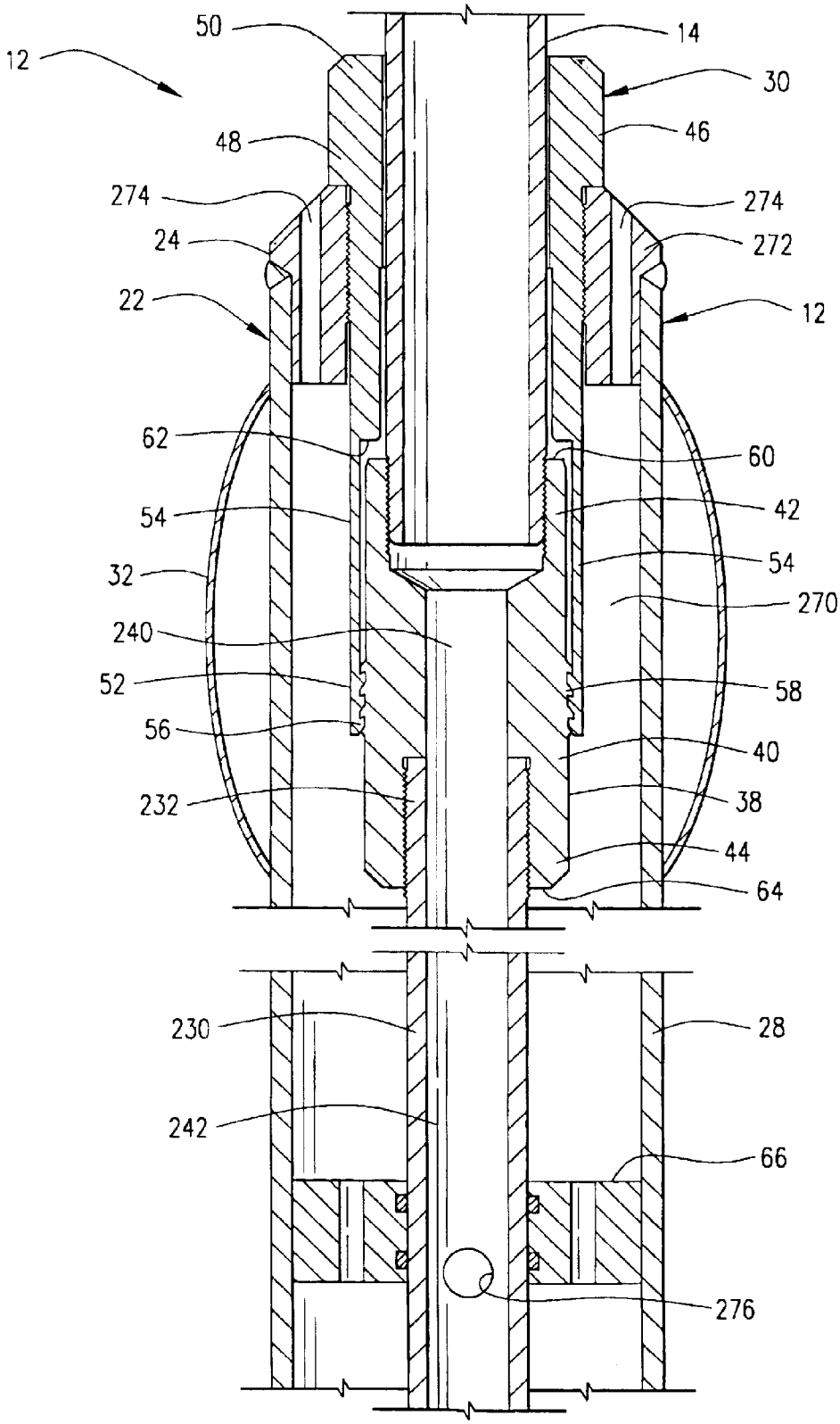
FIGS. 2A–2E show an enlarged longitudinal sectional view of the apparatus.
Figure 2:
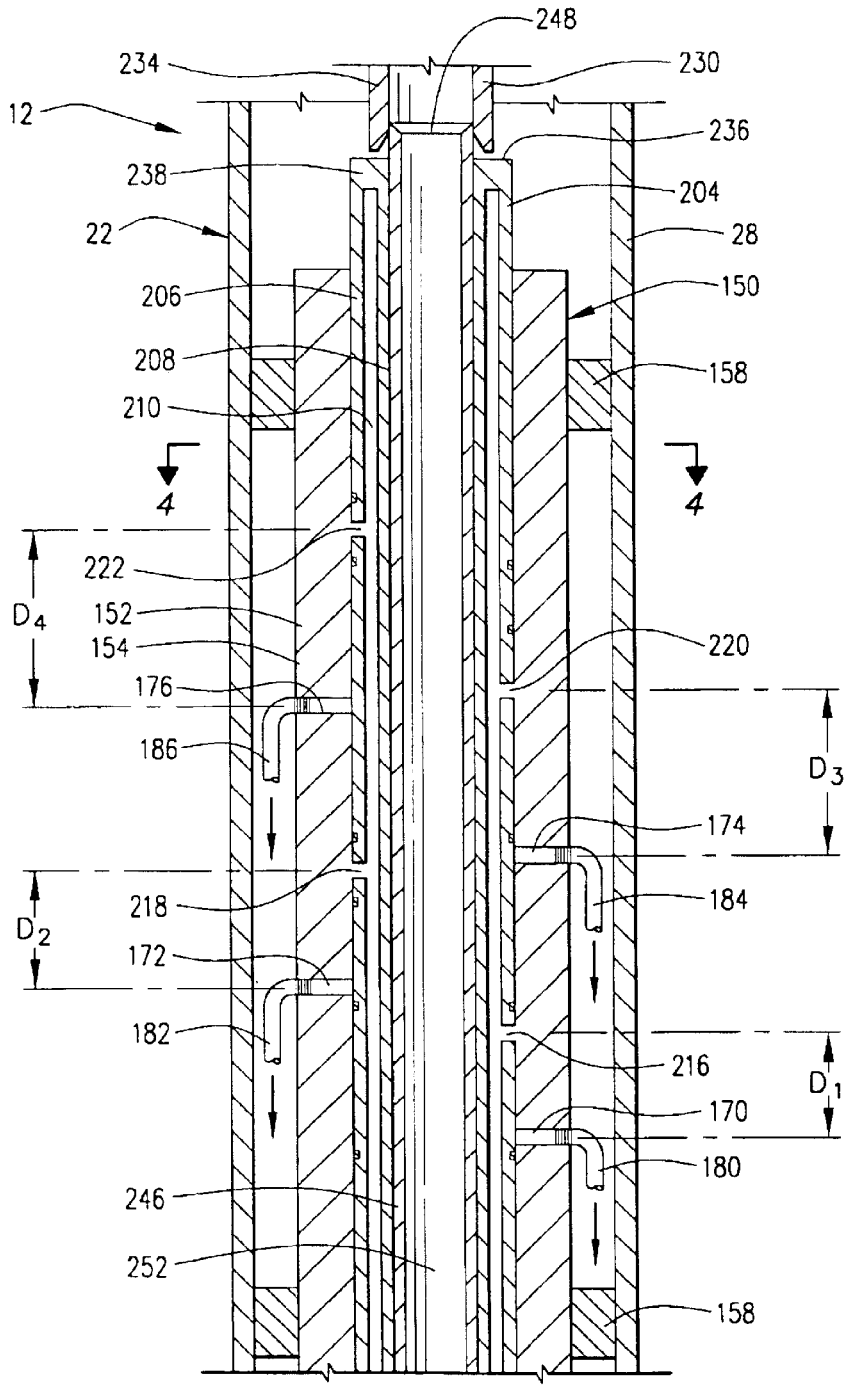

Once the housing 22 is positioned in the casing 16 at the desired level (FIG. 1), the lock assembly 30 can be disengaged from the locked position, shown in FIG. 2A, to the unlocked position. In the locked position, the drill string 14 is fixed relative to the housing. In the unlocked position, the drill string 14 and the attached inner collar 38 are axially movable a distance relative to the housing.

In the uppermost position of the drill string 14, shown in FIG. 2A, the annular shoulder 60 of the first end 42 of the inner collar 38 abuts the annular shoulder 62 inside the body 48 of the outer collar 46. From this uppermost position, the drill string 14 is movable to a lowermost position (not shown), in which the annular shoulder 64 on the second end 44 of the inner collar 38 abuts a stop in the housing 22, such as the stop ring 66. Thus, in the unlocked position, the drill string 14 can be moved axially within the housing 22 to operate the apparatus 12 in a manner fully described hereafter.

Turning now to FIG. 2D, the setting/pack-off assembly 36 will be described. The setting/pack-off assembly 36 is adapted to secure the apparatus 12 at the selected position in the casing 16 (FIG. 1). In one preferred construction, the setting/pack-off assembly 36 comprises a ring-shaped packer 68 and an opposing back-up plate 70. As shown, the packer 68 is positioned on one side of the sidewall 28 of the housing 22 and contoured to engage the inside wall of the well casing 16. The diameter and thickness of the packer should be selected to withstand the downhole pressures.

The back-up plate 70 is supported to extend from the housing 22 through the sidewall 28 opposite the packer 68. The back-up plate 70 is shaped to engage the inner wall of the casing 16. (See also FIG. 6, for example.) That is, in the preferred practice, the outer radius of the back-up plate 70 matches the inner radius of the well casing 16.

The surface area of the back-up plate 70 is selected depending on the diameter of the well casing 16. For example, for a 7-inch casing, a 50-square inch back-up plate is adequate. Care should be taken to ensure that the pressure exerted by the back-up plate is not excessive so as to avoid deformation or rupture of the casing.

The back-up plate 70 is supported by the housing 22 for movement in a first direction from a retracted position to an extended position. In the retracted position, shown in FIG. 2D, the back-up plate 70 does not engage the well casing 16 and allows axial movement of the apparatus 12. In the extended position, shown in FIGS. 8–10 discussed hereafter, the back-up plate 70 engages the casing 16 to secure the position of the apparatus 12 and provide a pressure-tight seal to the casing. More preferably, the back-up plate 70 is also movable in a second direction from the extended position back to the retracted position.

The setting/pack-off assembly 36 preferably comprises at least one and preferably a pair of fluid-driven piston assemblies 71, as shown in FIG. 2D. Each piston assembly 71 preferably comprises a piston cylinder 72 supported inside the housing 22 to enclose a fluid-driven piston 74 sealingly slidable therein. Thus, the piston 74 divides the cylinder 72 into a first chamber 76 having a port 77 and a second chamber 78 having a port 79. The back-up plate 70 is supported for movement with the piston 74 by a stem 80 extending between the back-up plate and the piston.

Movement of the piston 74 within the-cylinder 72 is driven by pressurized fluid entering the first chamber 76 or second chamber 78, depending on the desired direction. To supply the pressurized fluid, the apparatus 12 preferably also includes a pressurized fluid reservoir, such a high-pressure accumulator 84, shown in FIG. 2E. In most instances, the accumulator will be charged to 5,000 psi or greater, depending on factors such as depth of the apparatus in the well 18.

Conduits, described below, connect the accumulator 84 to the port 77 of the first chamber 76 and the port 79 of the second chamber 78 by means of a control assembly described hereafter. Thus, fluid from the accumulator 84 entering the first chamber 76 pushes the piston 74 in the first direction to the extended position. Likewise, fluid entering the second chamber 78 pushes the piston in tie second direction back to the retracted position. A dump chamber 86 (FIG. 2E) is connected to the first chamber 76 by conduit, described below, to permit fluid in the first chamber to escape when pressurized fluid enters the second chamber 78. The two chambers 76 and 78 of the cylinders 72 may be fluidly consolidated by connecting conduits 88 for simultaneous operation.

Referring still to FIG. 2D and also to FIG. 3, the preferred perforating assembly 34 now will be explained. The perforating assembly 34 comprises a piercing member 90, preferably an elongate body 92 with a front end 94 and a rear end 96 with a base 98. The front end 94 is adapted to pierce the well casing 16. The front end 94 may take many shapes, such as blunt, beveled or pointed; it may be symmetrical or asymmetrical.

One of the advantages of the present apparatus 12 is that it can be used to both perforate the well casing 16 and deliver or withdraw fluids through the perforation. To this end, it is preferred that the piercing member 90 include a fluid flow path. This path can take many forms. In the embodiment shown herein, the fluid flow path takes the form of an exterior, helical groove 100 formed on the body of the piercing member 90. Alternately, the flow path could take the form of straight, longitudinal grooves or splines, or one or more internal channels.

The piercing member 90 is supported in the housing 22 for movement from a first position to a second position. In the first position, shown in FIGS. 2D and 3, the piercing member 90 is contained within the housing 22. In the second position, shown in FIGS. 11–13, the piercing member 90 extends a distance through an opening 102 in the sidewall 28 of the housing 22 to pierce the well casing 16. More preferably, the piercing member 90 is movable from the second position to a third position. In the third position, shown in FIGS. 14–16 described below, the base 98 of the piercing member 90 occludes or plugs the perforation.

Figure 12:
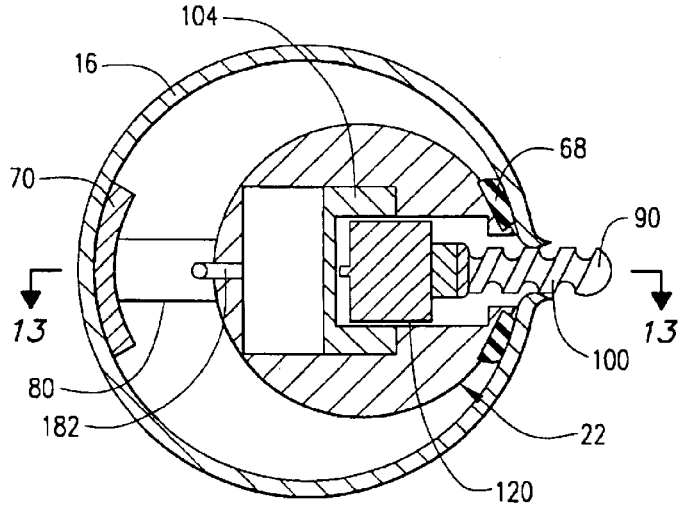
FIG. 12 is a cross-sectional view taken along line 12—12 of FIG. 11.
Figure 13:
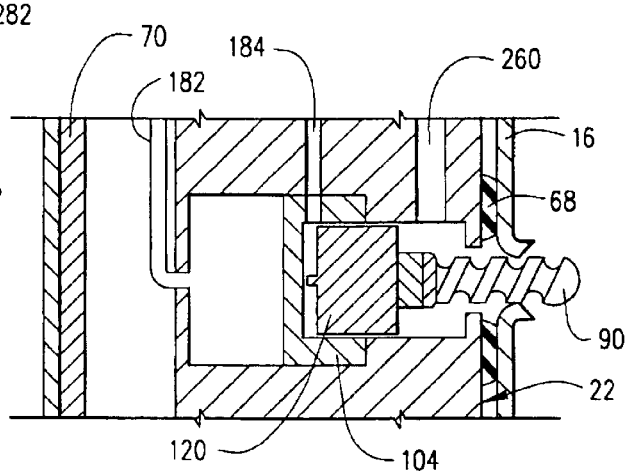
FIG. 13 is a longitudinal sectional view taken along FIG. 13—13 of FIG. 12.

A first fluid-driven piston 104 is slidably supported in a cylinder 106 mounted in the housing 22 so that the open end 107 of the cylinder is continuous with the opening 102 in the sidewall 28 of the housing 22. The first piston 104 comprises a body 108 with a rear end 110 and a front face 112. The first piston 104 is sealingly slidable in the cylinder 106 from the first position to a second position. In the first position, the rear end 110 of the first piston 104 is adjacent the rear of the cylinder 106, as shown in FIG. 3. In the second position, the front face 112 of the piston 104 abuts an annular shoulder 116 formed in the cylinder 106, as shown in FIGS. 12 and 13.

A recess 118 is formed within the body 108 and extends to the front face 112 of the first piston 104. The perforating assembly 34 preferably also includes a second fluid-driven piston 120 sized to be slidably and sealingly supported in the recess 118 of the first piston 104. Thus, the first and second pistons 104 and 120, where the second piston is seated inside the first piston, and both are supported in single cylinder, provide a compound or two-stage piston assembly.

The second piston 120 is formed by a body 122 having a front face 124 and a rear end 125. A nose 126, narrower than the body 122, extends from the front face 124. The base 98 of the piercing member 90 is attached to the end of the nose 126 by an aligning/shear pin 128 or some like device.

A first port 130 is formed in the cylinder 106 to supply fluid to cylinder behind the first piston 104 to move the first piston, and thus the second piston 120 and the piercing member 90, from the first position to the second position. A second port 132 is formed in the cylinder 106 to supply fluid into the recess 118 behind the second piston 120 through a connecting port 134 in the second piston. The second port 132 and the connecting port 134 are positioned so they become aligned when the first piston 104 is advanced to the second position (FIGS. 12 and 13).

Figure 15:
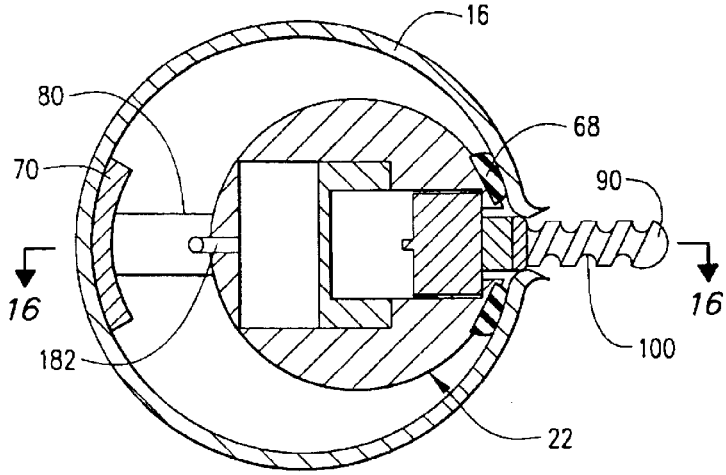
FIG. 15 is a cross-sectional view taken along line 15—15 of FIG. 14.
Figure 16:
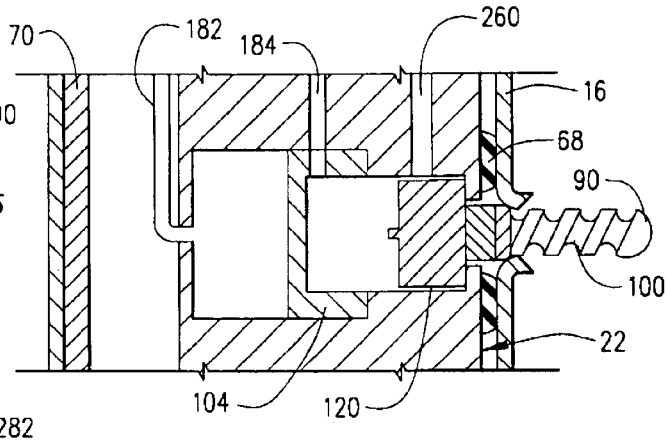
FIG. 16 is a longitudinal sectional view taken along FIG. 16—16 of FIG. 15.

When pressurized fluid enters through the second port 132, through the connecting port 134 and behind the rear end 126 of the second piston 120. This advances the second piston 120 to a position in which front face 124 abuts a second annular shoulder 138 on the inside of the cylinder 106 formed by the sidewall 28, as seen in FIGS. 15 and 16. This, in turn, advances the piercing member 90 to the third position to plug the perforation, as explained below.

Figure 3:
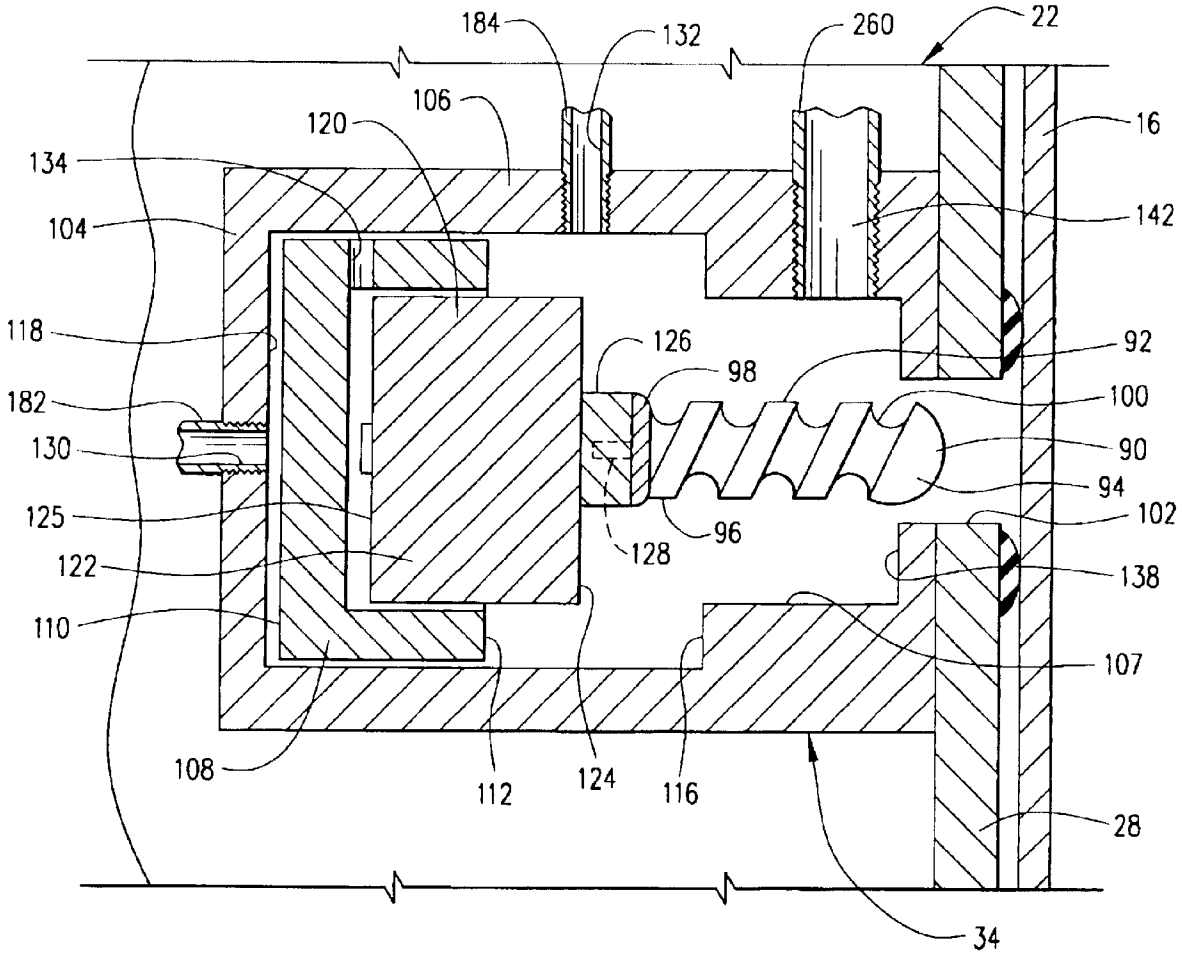
FIG. 3 shows an enlarged, sectional view of the perforating assembly of the apparatus.

With continuing reference to FIG. 3, a third port 142 formed in the cylinder 106, forward of the annular shoulder 116 provides a fluid flow path continuous with the helical groove 100 when the piercing member 90 is in the second position (FIGS. 12 & 13). Further, it will be seen that when the piercing member 90 is in the third position (FIGS. 15 & 16), the third port 142 is blocked by the body 122 of the second piston 120.

Although the arrangement can be varied, it will be understood that in the preferred embodiment, the perforating assembly 34 is positioned so that the piercing member 90 extends radially through the sidewall 28 of the housing 22. Likewise, as described herein, it is preferred that the setting/pack-off assembly 36 is configured so that the back-up plate 70 extends radially from the housing 22. Most preferably, the back-up plate 70 and piercing member 90 are positioned so that the back-up plate moves opposingly to the piercing member, as best seen in FIG. 3. For this reason, the packer ring 68 preferably is positioned around the opening 102 in the housing 22.

Figure 2C:
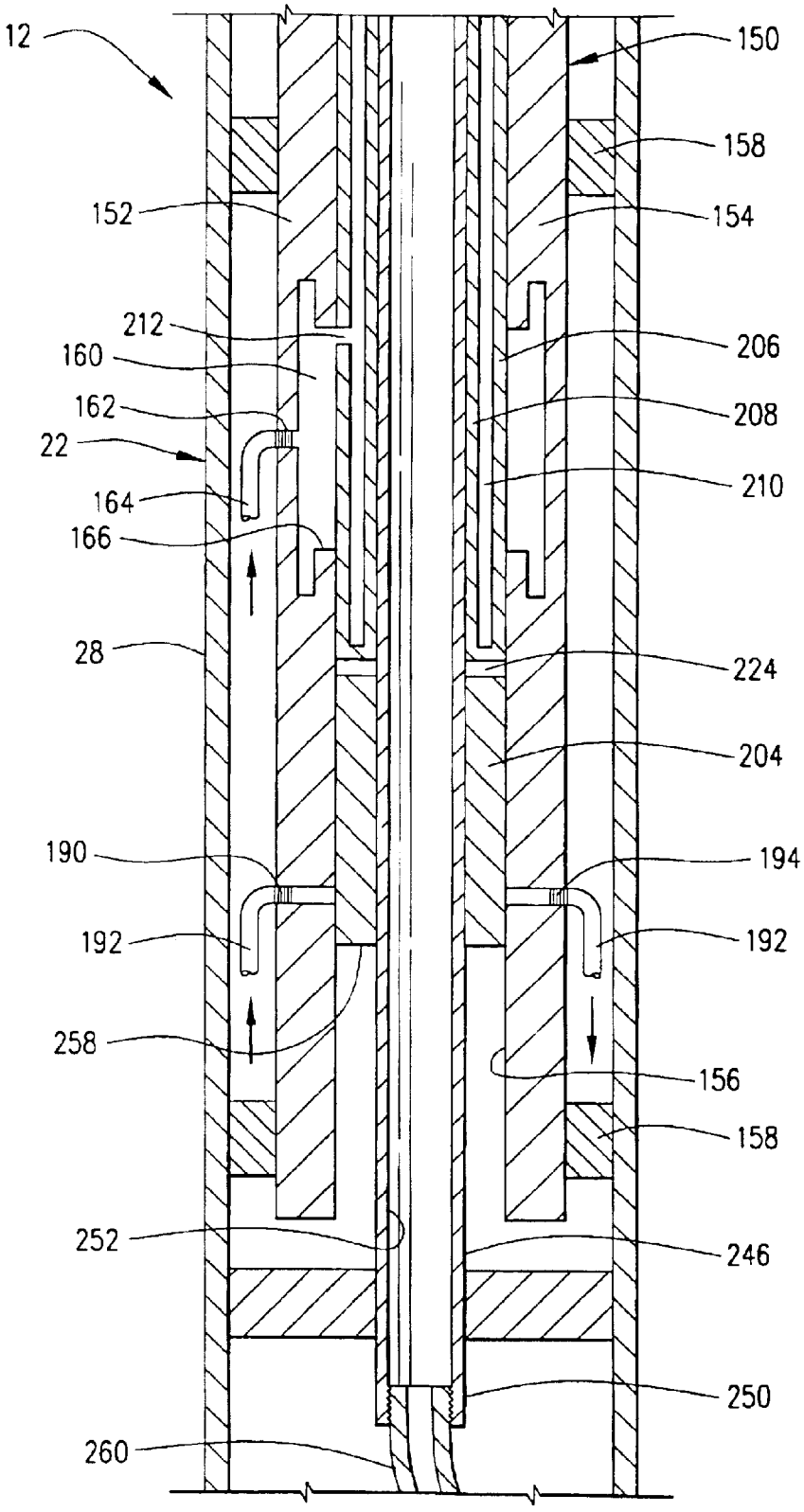
Figure 20:
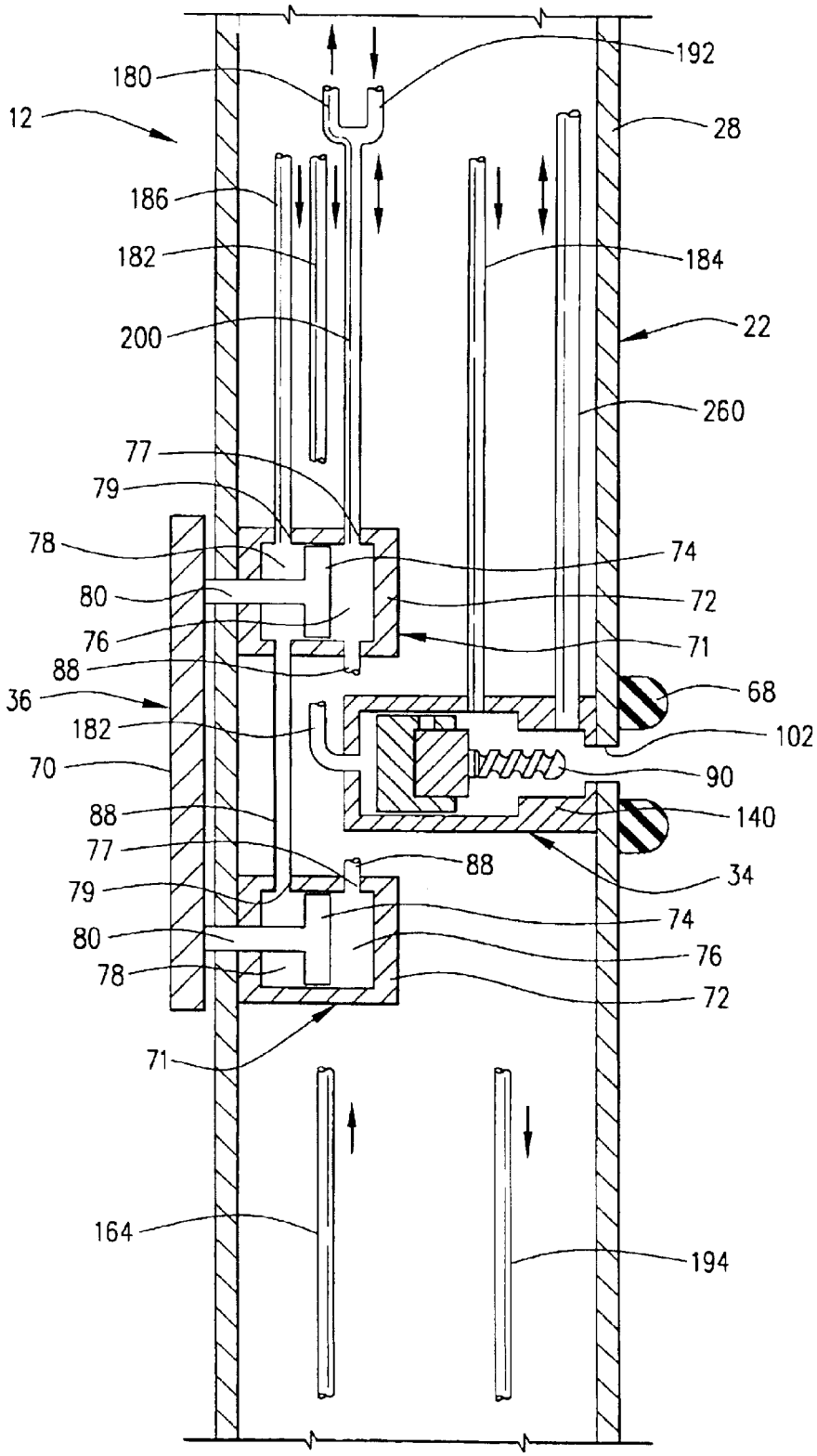
Figure 2E:
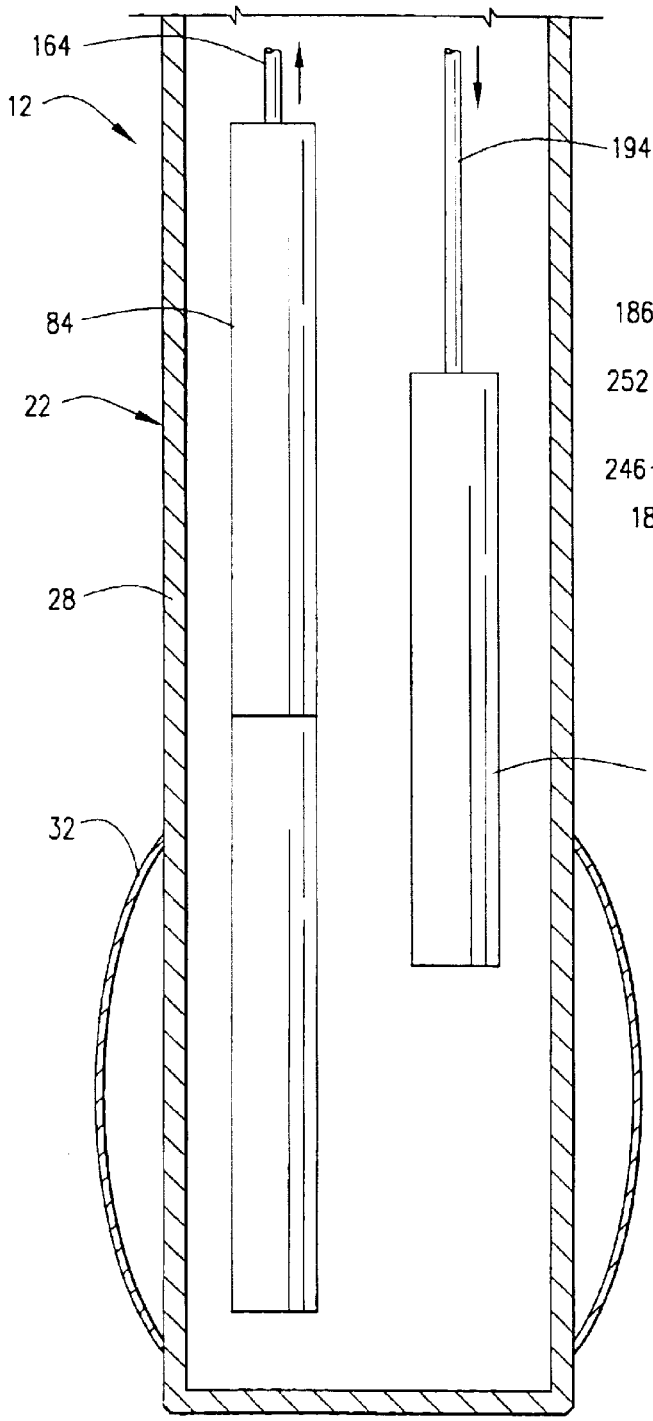
Figure 4:
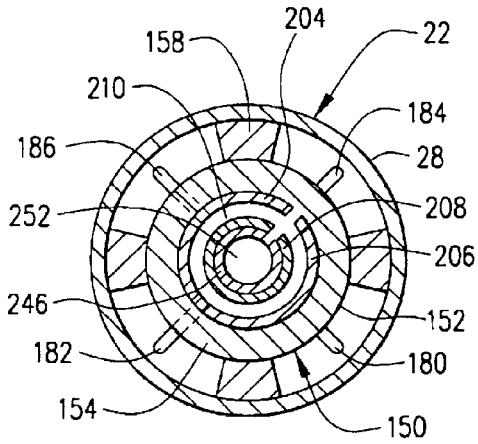
FIG. 4 shows a cross sectional view taken along line 4—4 in FIG. 2.

It will be apparent now that the pistons 74 of the setting/pack-off assembly 36 and the first and second pistons 104 and 120 of the perforating assembly 34 are to be operated sequentially and can be driven by the same source of pressurized fluid, namely, the accumulator 84 (FIG. 2E). To control the flow of fluid from the accumulator 84 to drive the pistons 74, 104 and 120 and, in turn, to control the movement of the back-up plate 70 and the piercing member 90, a control assembly is provided in the apparatus.

A preferred control assembly is the first or operating valve 150 illustrated in FIGS. 2B–2C. The operating valve 150 comprises a valve body 152 which may take many shapes. Preferably, the valve body is cylindrical to provide a tubular sidewall 154 that defines a longitudinal throughbore 156. The valve body 152 may be mounted in the housing 22 by means of annular rings 158 or any other suitable device.

As shown in FIG. 2C, the sidewall 154 preferably includes a fluid chamber 160 to contain an amount of pressurized fluid. The sidewall 154 further includes at least one inlet 162 fluidly connecting the fluid chamber 160 to the accumulator 84 by a conduit 164. An opening 166 continuous with the fluid chamber 160 is provided on the throughbore 156.

The sidewall 154 preferably includes at least one outlet and, more preferably, a plurality of outlets, shown in FIG. 2B. Even more preferably, the sidewall 154 is provided with a plurality of longitudinally spaced-apart outlets 170, 172, 174 and 176, each of which is provided with conduits 180, 182, 184 and 186, respectively. The conduits 180, 182, 184 and 186 are connected to the port 77 of the back-up plate cylinder 72, the ports 130 and 132 of the perforating assembly cylinder 104, and the port 79 of the second chamber 78 of the back-up plate cylinder 72, respectively. See also FIGS. 2D and 3.

The sidewall 154 of the valve body 152 further preferably includes a second inlet 190, to which a conduit 192 is attached, and a fifth outlet 194, to which a conduit 196 is attached. The conduit 192 is connected to the port 77 of the first chamber 76 of the back-up plate cylinder 72, and the conduit 194 is connected to the dump chamber 86, shown in FIG. 2E, for a reason to be explained below.

As seen in FIG. 2D, both the conduit 192 to the second inlet 190 of the valve body 152 and the conduit 180 from the first outlet 170 of the valve body need to connect to the port 77 of the first chamber 76 of the back-up plate cylinder 72. Thus, it is convenient to have both conduits merge into a common conduit 200, so that only the one port 77 is necessary in the first chamber. Alternately, a second port could be provided in the first chamber 76 for connection to the conduit 192.

Referring still to FIGS. 2B and 2C, the valve 150 preferably further comprises a sleeve 204. The sleeve 204 is slidably and sealingly received inside the throughbore 156 of the valve body 152. The sleeve 204 comprises an outer wall 206, an inner wall 208, and an annular space 210 therebetween. A fluid inlet 212 (FIG. 2C) is provided in the outer wall 206 and is in fluid communication with the annular space 210. The fluid inlet 212 is sized and positioned in the sleeve 204 so as to remain aligned with the opening 166 in the throughbore 156 of the sleeve 204 for a portion of the distance traveled by the sleeve, in a manner to be described.

In addition, at least one outlet, and preferably a plurality of outlets, also in communication with the annular space 210, is formed in the outer wall 206, as seen in FIG. 2B. Most preferably, each one of the plurality of outlets in the outer wall 206 of the sleeve 204 corresponds to a respective one of the plurality of outlets in the valve body 152. Accordingly, the outer wall 206 includes a first outlet 216 corresponding to the first outlet 170, a second outlet 218 corresponding to the second outlet 172, a third outlet 220 corresponding to the third outlet 174, and a fourth outlet 222 corresponding to the fourth outlet 176. In addition, a pass-through channel 224 (FIG. 2C) is provided in the sleeve 204 to connect the inlet 192 and the outlet 194 in the valve body 152.

For operation of the valve 150, the sleeve 204 is movable from a closed or locked position to one of a plurality of valving positions. In the locked position, shown in FIGS. 2B and 2C, none of the outlets in the sleeve 204 is aligned with an outlet in the body 152. In each of plurality of valving positions, at least one of the outlets in the sleeve 204 is aligned with an outlet in the body 152.

In the preferred embodiment, the valving positions include a first, second, third and fourth valving positions. In all these valving positions, pressurized fluid from the accumulator 84 (FIG. 2E) enters the fluid chamber 160 through the conduit 164 and the first inlet 162, and then flows into the annular space 210 of the sleeve 204 through the first inlet 212. However, in each of the valving positions, a different outlet in the valve body 152 is aligned with its corresponding outlet in the sleeve 204.

In the first valving position, or the setting position, the sleeve 204 has been moved a distance $D_1$ so that the first outlet 170 in the body 152 is aligned with the first outlet 216 in the sleeve 204. Accordingly, pressurized fluid flows through the conduit 180 to the move the pistons 74 (FIG. 2D) of the setting/pack-off assembly 36 to extend the back-up plate 70 and set the apparatus 12.

In the second valving position, or the perforating position, the sleeve 204 has been moved a distance $D_2$ so that the second outlet 172 in the body 152 is aligned with the second outlet 218 in the sleeve 204. Thus, fluid is directed through the conduit 182 to the move the first piston 104 (FIG. 2D) in the perforating assembly 34 and the piercing member 90 to the first position to pierce the well casing 16.

In the third valving position, or the plugging position, the sleeve 204 has been moved a distance $D_3$ so that the third outlet 174 in the body 152 is aligned with the third outlet 220 in the sleeve 204. Now, fluid is directed through the conduit 184 to move the second piston 120 (FIG. 2D) and thus the piercing member 90 to the second position to plug the perforation in the well casing 16.

In the fourth valving position, or the dump and release position, the sleeve 204 has been moved a distance $D_4$ so that the fourth outlet 176 in the body 152 is aligned with the fourth outlet 222 in the sleeve 204 to direct fluid through the conduit 186 to the second chamber 78 of the back-up plate cylinder 72 (FIG. 2D). This pushes the back-up plate piston 74 backwards towards the retracted position. Simultaneously, in the fourth valving position, the annular pass-through channel 224 of the sleeve 204 is aligned with the second inlet 190 and the fifth outlet 194. In this way, fluid in the first chamber 76 of the back-up plate cylinder 72 can escape through the conduits 198 and 192, through the valve 150, and through the conduit 196 into the dump chamber 86 (FIG. 2E). Thus, the setting/pack-off assembly 36 is disengaged and apparatus 12 can be lifted out of the well 18.

As mentioned previously, it is desirable to control the operating valve 150 by moving the drill string 14. In the preferred practice of this invention, this feature is provided by including a push tube 230, as best seen in FIGS. 2A and 2B. The push tube 230 has a first end 232 (FIG. 2A) and a second end 234 (FIG. 2B). The first end 232 is attached, such as by a threaded connection, to the second end 44 of the inner collar 38 of the lock assembly 30. In this way, the push tube moves axially with the inner collar 38 and the drill string 14.

The push tube 230 may be supported conveniently within the housing 22 by the annular stop ring 66. The second end 234 is sized and positioned to engage the annular shoulder 236 on the end 238 (FIG. 2B) of the valve sleeve 204, when the sleeve is in its uppermost position in the valve 150. Thus, once the locking assembly 30 is moved to the unlocked position, downward movement of the drill string 14 moves the inner collar 38, the attached push tube 230 and thus the valve sleeve 204 from the closed position to the plurality of valving positions sequentially.

As explained, it is advantageous to establish a fluid flow path through the same apparatus that makes the perforation. In the preferred embodiment, the drill string 14 used to support the apparatus 12 downhole provides a conduit from the surface to the apparatus. This flow passage preferably is continued through the apparatus 12 itself. To that end, as shown in FIG. 2A, the inner collar 38 that attaches the push tube 230 to the drill string 14 may be provided with a throughbore to provide an inlet 240 to the housing 22. The operating fluid flow path is continued by making the push tube 230 hollow to form a flow passage 242 therethrough continuous with the inlet 240 of the inner collar 38 and the drill string 14.

As shown in FIGS. 2B and 2C, the operating fluid flow passage preferably is continued through the housing 22 by including a hollow or tubular support stem 246. The stem 246 has a first end 248, a second end 250 and a throughbore 252. In its preferred form, the stem 246 has a length greater than the valve sleeve 204 of the valve 150. Thus, as seen in FIG. 2B, the first end 246 of the stem 246 extends a distance above the first end 238 of the valve sleeve 204. Similarly, as seen in FIG. 2C, the second end 250 extends a distance below the second end 258 of the valve sleeve. The support stem 246 is receivable inside the sleeve 204 of the valve 150 so that the sleeve is slidable over the stem. A conduit 260 extends from the second end 250 of the stem 246.

Now it will be seen from FIGS. 2A–2D that an operating fluid flow channel is established beginning with the inlet 240 of the inner collar 38, through the flow passage 242 in the push tube 230, through the throughbore 252 of the stem 246, through the conduit 260 to the perforating assembly cylinder 106, through the helical groove 100 of the piercing member 90. In this way, once the piercing member 90 has been advanced to perforate the well casing 16, fluid can be flowed in either direction between the surface and outside the well casing 16. That is, fluid from the surface can be injected through perforation, and fluid from the formation 20 can withdrawn from the formation 20 for testing or other purposes.

In some applications of this invention, it is desirable to be able to flow fluid from the surface through the apparatus 12 and back up the well casing 16 outside the drill string 14. For example, following a squeeze operation, it is desirable to flush the well of any cement remaining inside the casing. For this purpose, the apparatus 12 advantageously includes a second, alternate or return flow path inside the housing 22.

More particularly, and referring now again to FIGS. 2A and 2B, the upper portion of the housing 22 preferably defines a flow chamber 270 surrounding a least a portion of the push tube 230. The housing 22 may be closed at the first end 24 by an end cap 272 having one or more outlets 274 continuous with the flow chamber 270. As seen in FIG. 2A, an opening 276 in the push tube 230 provides communication between the flow passage 242 through the push tube 230 and the flow chamber 270 in the housing 22.

As described previously, the push tube 230 is telescopically received on the stem 246 of the housing 22. Thus, as the push tube 230 is pushed downwardly by the drill string 14, the stem 246 moves upwardly inside the push tube. Now it will be apparent that, by positioning the opening 276 properly, a second return flow path is created in the apparatus 12. The second or return flow path extends from the surface through the drill string 14, through the flow passage 242 of the push tube 230, out the opening 276, up the flow chamber 270, out the outlets 274 in the end cap 272 and back up the well casing 16.

Access to the return flow path preferably is controlled by axial movement of the drill string 14. In the position shown in FIG. 2A, the return flow path is open because the push tube 230 is high enough in its path of travel that the opening 276 is above the upper end 248 of the stem 246 (see FIG. 2B). Although not shown in the drawings, it is apparent that when the push tube 230 is pushed downwardly a certain distance over the stem 246, the opening 276 will be occluded by the wall of the stem 246 closing the return flow path.

Once the operation of the valve 150 is completed (the back-up plate 70 has been extended, the well casing 16 has been perforated by the piercing member 90, and the back-up plate has been retracted again), the push tube 230, or flow pattern valve, can be pulled back up to the starting position to reopen the return flow path. Thus, the opening 276 in the push tube 230 in combination with the stem 246 constitutes a second valve 278, or a "flow pattern" valve, to control access to the return flow path. It will also be appreciated that the opening 276 is positioned so that the return flow path is open when the sleeve 204 is in the closed position, and so that the return flow path is closed when the sleeve is in one of the valving positions.

Having described the apparatus 12 in detail, its use and operation will be explained in further detail. First, referring to FIGS. 5–7, the inner diameter of the well casing 16, or other tubular structure, is determined, and an apparatus 12 of appropriate size is selected. The size of the apparatus 12, and more particularly the dimensions of the bow spring centralizers 32, should be selected to provide a frictional fit inside the well casing 16. The fit should be snug enough to support the apparatus 12 against movement in the casing 16, that is, to allow the centralizers 32 to rub along the casing wall. On the other hand, the fit should permit the apparatus 12 to be pushed down and pulled up inside the well casing 16 by the drill string 14. The width of the apparatus 12 at the level of the setting/pack-off assembly, that is, the width of the apparatus including the back-up plate 70 and packer 68 should permit a small but sufficient clearance, preferably about ¼ inch. It will be seen that this clearance is exaggerated in the drawings for purposes of illustration.

Figure 5:
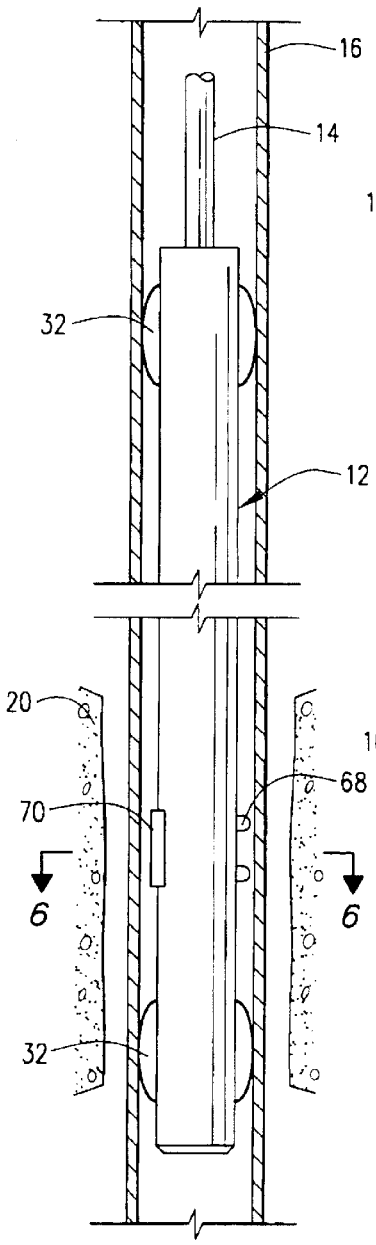
FIG. 5 is a partially sectional view of a well with the apparatus of the present invention being pushed down the well casing.
Figure 6:
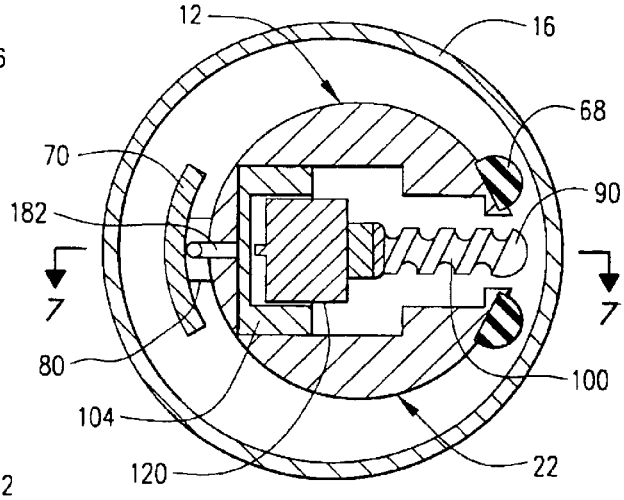
FIG. 6 is a cross-sectional view taken along line 6—6 of FIG. 5.
Figure 7:
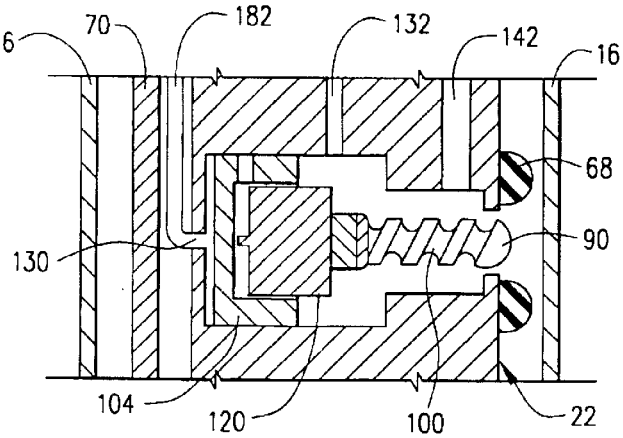
FIG. 7 is a longitudinal sectional view taken along line 7—7 of FIG. 6.

Next, the apparatus 12 is connected to the end of the drill string 14 (or coiled tubing or other elongate conduit). The apparatus 12 then is pushed down the well casing 16 to the desired level adjacent the target formation 20. During the installation of the apparatus 12 in the well 18, the back-up plate 70 and the piercing member 90 (FIGS. 6 & 7) are both in the retracted position, as shown in FIGS. 5–7, and the packer 68 is not compressed. The operating valve 150 is in the closed or locked position.

Figure 8:
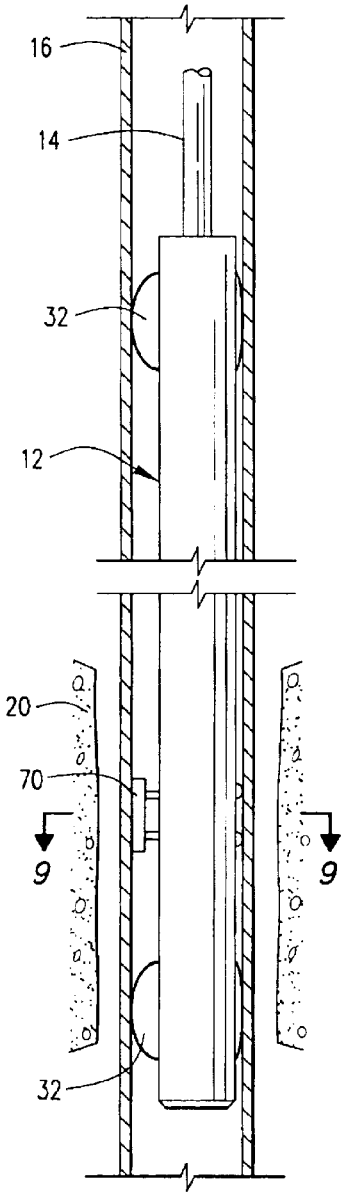
FIG. 8 is a partially sectional view of a well showing the apparatus as it is stabilized in the selected position.
Figure 9:
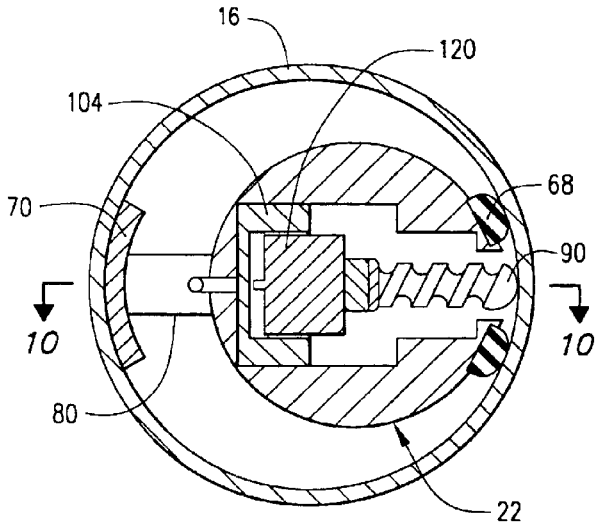
FIG. 9 is a cross-sectional view taken along line 9—9 of FIG. 8.
Figure 10:
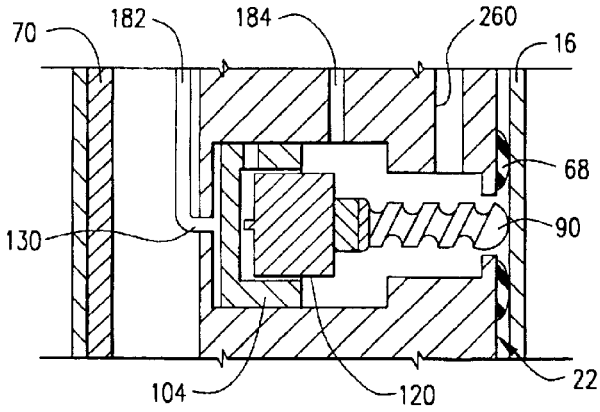
FIG. 10 is a longitudinal sectional view taken along FIG. 10—10 of FIG. 9.

Turning to FIGS. 8–10, once the apparatus 12 is positioned in the well casing 16, the back-up plate 70 is extended to secure the apparatus at the selected position. To do this, the drill string 14 is rotated to release the locking assembly 30 (FIG. 2A) so that the drill string can be moved axially in the housing 22.

Then, the drill string 14 is pushed down the first distance $D_1$ (FIG. 2B) to move the valve 150 to the first valving position or the setting position. This extends the back-up plate 70 to the second or extended position, as shown in FIGS. 8–10. The housing 22 is forced against the opposite side of the well casing 16 and compresses the packer 68. Thus, the back-up plate 70 on one side and the packer 68 on the other side frictionally secure the housing 22 in the casing 16.

To verify that the setting/pack-off assembly 36 has been effectively set, the locking assembly 30 (FIG. 2A) is re-set by pulling up on the drill string 14 as previously described. Then, upward tension is applied to the drill string 14. Increased resistance on the drill string 14 evidences successful deployment of the setting/pack-off assembly 36.

Figure 11:
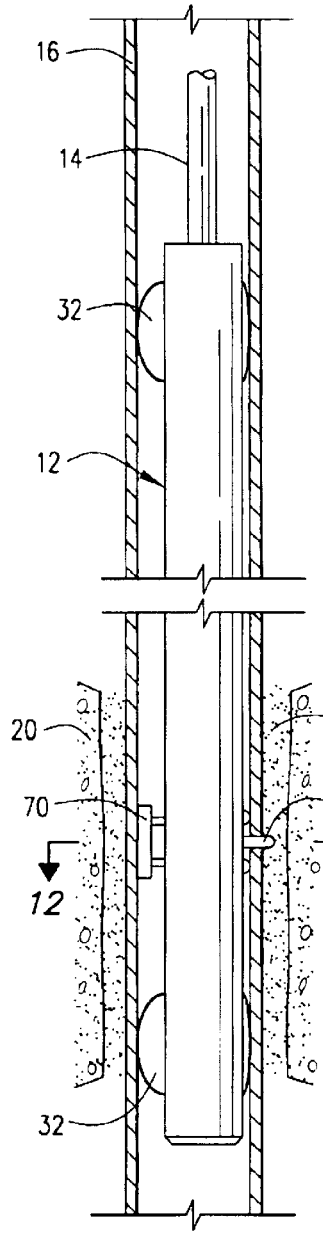
FIG. 11 is a partially sectional view of a well showing the apparatus as it perforates the casing.

After securing the apparatus 12 to the well casing 16, and again releasing the lock assembly 30, the piercing member 90 is projected, as shown in FIGS. 11–13. The drill string 14 is then pushed down the distance $D_2$ (FIG. 2B) to move the valve 150 to the perforating or second valving position. This opens pushes the piercing member 90 from the first position to the second position to pierce the well casing 16.

With the piercing member 90 in this position, the operating fluid flow path through the housing 22 through the perforating assembly 34 is established, as shown in FIGS. 12 and 13. In this mode, flowable material may be flowed between the surface and the selected area outside the well casing 16. In the squeezing operation used to illustrate the invention, for example, cement 282 is injected through conduit 260, through the cylinder 106, along the helical groove 100 on the piercing member 90 and out perforation into the annulus outside the well casing 16.

Figure 14:
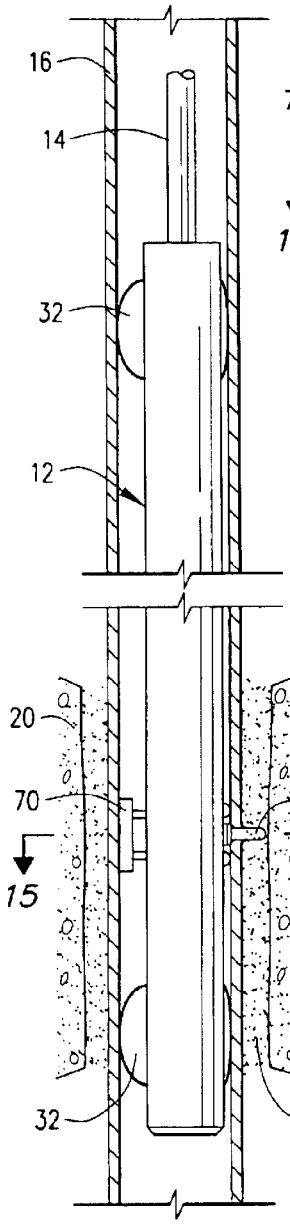
FIG. 14 is a partially sectional view of a well showing the apparatus as the perforating assembly plugs the hole in the casing.

Before removing the apparatus 12, the perforation is plugged, as shown in FIGS. 14–16, to prevent a significant amount of cement from seeping back inside of the well casing. The drill string 14 is pushed downwardly the third distance $D_3$ (FIG. 2B) to move the valve 150 to the plugging or third valving position. This moves the piercing member 90 to the third position where the nose 126 of the second piston 120 extends through the sidewall 28 of the housing 22 and the base 98 of the piercing member 90 plugs the perforation.

Next, as seen in FIGS. 17–19, the back-up plate 70 is retracted by pushing the drill string 14 down the fourth distance $D_4$ (FIG. 2B), moving the valve 150 to the dump and release position, or the fourth valving position. This moves the back-up plate 70 back to the retracted position, and frees the apparatus 12 to be lifted out of the well casing 16.

Before lifting the apparatus 12, the casing 16 can be flushed to remove any cement that may have seeped into it. To do this, the second valve 278 (FIG. 2A) is opened by pulling up on the drill string 14 to pull the push tube 230 up to the start position in which the opening 276 is open to the flow chamber 270. Then fluid, such as water or drilling mud, can be injected down the drill string 14 and back up the casing outside the drill string to flush any remaining cement or other material out of the well 18.

Having completed the flushing process, the apparatus 12 is lifted out of the well casing 16. Before lifting the apparatus, the locking assembly 30 (FIG. 2A) can be reset to the locked position. As illustrated in FIGS. 18 and 19, the pulling force exerted when lifting the apparatus 12 will break the aligning/shear pin 128 (FIG. 3) on the base 98 of the piercing member 90, leaving the piercing member 90 and its base 98 in the perforation, as shown in FIGS. 18 and 19.

Once the apparatus 12 has been removed from the well 18, the apparatus can be redressed for future use. The accumulator 84 is recharged, the dump chamber 86 is emptied, a new piercing member 90 is attached to the second piston 120 of the perforating assembly 34, and the first and second pistons 104 and 120 are returned to their starting positions. In this way, the apparatus 12 can be reused indefinitely.

It will be understood that the various components each can be modified and adapted to perform according to the intended use of the apparatus. The structure of the apparatus shown in the drawings is merely exemplary of many possible configurations and arrangements. For example, the housing is shown as a hollow cylinder, with separately installed piston cylinders. Alternately, the housing could be formed of solid material, and the cylinders machined into the housing.

In addition, the relative positions of the dump chamber, high-pressure accumulator, and valve body can be changed.

Finally, it will also be appreciated that in some of the drawings some minor structures have been simplified or omitted from the drawings to clarify the illustration. For example, o-rings or other seals are not shown in the valves and piston assemblies, as their use is understood.

Changes can be made in the combination and arrangement of the various parts and elements described herein without departing from the spirit and scope of the invention as defined in the following claims.

What is claimed is:

1. An apparatus for for use with an elongate conduit for withdrawing and injecting fluid through the wall of a tubular structure, the apparatus comprising:

a housing having a first end defining an inlet connectable to the elongate conduit, the housing being supportable at a selected position in the tubular structure and defining an operating fluid flow path beginning with the inlet;

a fluid driven perforating assembly in the housing, the perforating assembly comprising a piercing member supported for movement from a first position within the housing to a second position in which a portion of the piercing member is extendable through the tubular structure forming a perforation therein, wherein the piercing member comprises a fluid flow path;

wherein the perforating assembly defines a fluid flow path continuous with the operating fluid flow path through the housing and the fluid flow path in the piercing member so that when the piercing member is in the second position a continuous flow path is formed between the inlet of the housing and the portion of the piercing member that is extendable through the tubular structure;

a fluid driven setting/pack-off assembly adapted to releasably secure the housing at the selected position in the tubular structure and to provide a releasable seal between the inside of the tubular structure outside the apparatus and the fluid flow paths in the housing, the piercing member and the perforating assembly of the apparatus;

a pressurized fluid reservoir contained in the housing and operatively connected to the seal assembly and the perforating assembly; and an operating valve adapted to control fluid flow between the fluid reservoir and the seal assembly and between the fluid reservoir and the perforating assembly, the operating valve operable independent of fluid flow in the elongate conduit.

2. The apparatus of claim 1 wherein the first end of the housing is adapted for connection to an elongate conduit extending from one end of the tubular structure so that the conduit is continuous with the inlet of the housing.

3. The apparatus of claim 2 wherein the apparatus further comprises a releasable lock assembly operable by rotation of the elongate conduit between a locked position, in which the elongate conduit is fixed relative to the housing, and an unlocked position, in which the elongate conduit is axially movable relative to the housing.

4. The apparatus of claim 3 further comprising a friction member on the housing sized to frictionally engage the tubular structure as the apparatus is pushed through the tubular structure.

5. The apparatus of claim 4 wherein the friction member is a bow-spring centralizer.

6. The apparatus of claim 3 wherein the perforating assembly comprises a cylinder, wherein the piercing member is slidably supported in the cylinder, wherein the perforating assembly further comprises a first fluid-driven piston in the cylinder for driving the movement of the piercing member, wherein the fluid reservoir fluidly connected to the cylinder so that when the reservoir is filled with pressurized fluid the fluid can drive the piston, and wherein the operating valve is adapted to control the flow of pressurized fluid from the reservoir to the cylinder.

7. The apparatus of claim 6 wherein the setting/pack-off assembly comprises:

a back-up plate sized to engage the tubular structure and movable in a first direction from a retracted position in which the back-up plate does not engage the tubular structure to an extended position in which the back-up plate engages the tubular structure;

a packer on the sidewall opposite the back-up plate shaped and positioned to surround the piercing member when the piercing member is in the second position;

a cylinder supported in the housing;

a fluid-driven piston sealingly slidable within the cylinder and dividing the cylinder into a first chamber and a second chamber;

a stem extending between the back-up plate and piston and;

wherein the first chamber of the cylinder is fluidly connected to the pressurized fluid reservoir to push the piston in the first direction when the reservoir contains pressurized fluid; and wherein the operating valve controls the flow of fluid from the fluid reservoir to the cylinder of the setting/pack-off assembly.

8. The apparatus of claim 7 wherein the housing is cylindrical defining a sidewall, wherein the piercing member extends radially through the sidewall, and wherein the back-up plate extends radially from the sidewall of the housing and is positioned to move opposingly to the piercing member.

9. The apparatus of claim 7 wherein the piercing member comprises a base and is movable from the second position to a third position in which the base is extendable through the perforation made by the piercing member to occlude the perforation, wherein first piston of the perforating assembly comprises a recess, wherein the perforating assembly further comprises a second fluid-driven piston slidably receivable in the recess for driving movement of the piercing member from the second position to the third position, wherein the recess is fluidly connected to the pressurized fluid reservoir so that when the reservoir is filled with pressurized fluid the fluid can drive the movement of the second piston, and wherein the operating valve is adapted to control the flow of fluid from the reservoir to the recess.

10. The apparatus of claim 9 wherein the operating valve comprises:

a valve body having a tubular sidewall defining a longitudinal throughbore, wherein the sidewall comprises a first inlet fluidly connected to the pressurized fluid reservoir, and a plurality of longitudinally spaced-apart outlets, a first one of the plurality of outlets fluidly connected to the first chamber of the cylinder of the setting/pack-off assembly to drive the piston in the first direction, a second one of the plurality of outlets fluidly connected to the cylinder of the perforating assembly to drive the movement of the first piston, a third one of the plurality of outlets fluidly connected to the cylinder of the perforating assembly to drive the movement of the second piston;

a sleeve sealingly slidable inside the throughbore of the valve body;

wherein the sleeve comprises an outer wall, an inner wall, an annular space therebetween, a fluid inlet in the outer wall in fluid communication with the annular space, and a plurality of outlets in the outer wall in fluid communication with the annular space, each one of the plurality of outlets corresponding to a respective one of the plurality of outlets in the valve body;

wherein the sleeve is axially movable from a closed position, in which none of the outlets in the sleeve is aligned with an outlet in the body, to a plurality of valving positions including a first valving position in which the first outlet in the body is aligned with the corresponding outlet in the sleeve, a second valving position in which the second outlet in the body is aligned with the corresponding outlet in the sleeve, and a third valving position in which the third outlet in the body is aligned with the corresponding outlet in the sleeve; and wherein the apparatus further comprises a push tube slidably supported in the housing and having first and second ends, the first end connectable to the elongate conduit for axial movement therewith when the lock assembly is in the unlocked position, the second end sized and positioned to engage the sleeve of the operating valve to cause axial movement thereof to move the sleeve from the closed position to the plurality of valving positions.

11. The apparatus of claim 10 wherein the apparatus further comprises a dump chamber adapted to receive fluid, wherein the back-up plate is further defmed as movable in a second direction from the extended position to the retracted position, wherein the plurality of outlets in the valve body includes a fourth outlet fluidly connected to the second chamber of the cylinder of the setting/pack-off assembly to drive the movement of the piston in the second direction, wherein the valve body includes a second inlet fluidly connected to the first chamber of the cylinder of the setting/pack-off assembly, wherein the valve body includes a fifth outlet fluidly connected to the dump chamber, wherein the sleeve of the operating valve comprises a pass-through channel, and wherein the sleeve is movable to a fourth valving position in which the fourth outlet in the body is aligned with the corresponding outlet in the sleeve to direct pressurized fluid into the second chamber of the back-up plate cylinder and in which the pass-through channel in the sleeve connects the second inlet of the valve body with the fifth outlet to permit fluid in the first chamber of the back-up plate cylinder to escape to the dump chamber.

12. The apparatus of claim 11 wherein the push tube defines a flow passage continuous with the elongate conduit, wherein the push tube is sealingly slidable on the support stem in the housing, wherein the support stem defines a flow passage continuous with the flow passage of the push tube, wherein the flow passage of the support stem is fluidly connected to the cylinder of the perforating assembly so that the flow path in the piercing member is continuous with the support stem.

13. The apparatus of claim 12 wherein the housing comprises a return flow path inside the housing above the valve body, wherein the housing comprises an outlet connecting the return flow path with the outside of the housing, wherein the push tube serves as a flow valve and includes an opening positioned to be open to the return flow path in the housing when the sleeve is in the closed position and to be sealed by the support stem when the sleeve is in one of the plurality of valving positions, so that when the apparatus is connected to the elongate outlet and positioned in the tubular structure fluid can be passed through the elongate conduit, through the push tube, through the opening in the push tube into the return flow path in the housing, through the outlet in the housing to the outside of the housing.

14. The apparatus of claim 1 wherein the perforating assembly comprises a cylinder, wherein the piercing member is slidably supported in the cylinder, wherein the perforating assembly further comprises a first fluid-driven piston in the cylinder for driving the movement of the piercing member, wherein the pressurized fluid reservoir is fluidly connected to the cylinder so that when the reservoir is filled with pressurized fluid the fluid can drive the piston, and wherein the operating valve is adapted to control the flow of pressurized fluid from the reservoir to the cylinder.

15. The apparatus of claim 14 wherein the piercing-member comprises a base, wherein the piercing member is movable from the second position to a third position in which the base is extendable through the perforation made by the piercing member to occlude the perforation, wherein first piston comprises a recess, wherein the perforating assembly further comprises a second fluid-driven piston slidably receivable in the recess for driving movement of the piercing member from the second position to the third position, wherein the recess is fluidly connected to the pressurized fluid reservoir so that when the reservoir is filled with pressurized fluid the fluid can drive the movement of the second piston, and wherein the operating valve is adapted to control the flow of fluid from the reservoir to the recess.

16. The apparatus of claim 15 wherein the housing comprises a support stem and wherein the operating valve comprises:

a valve body having a tubular sidewall defining a longitudinal throughbore, wherein the sidewall comprises a first inlet fluidly connected to the pressurized fluid reservoir, and a plurality of longitudinally spaced-apart outlets, one of the plurality of outlets fluidly connected to the cylinder of the perforating assembly to drive the movement of the first piston, another one of the plurality of outlets fluidly connected to the cylinder of the perforating assembly to drive the movement of the second piston;

a sleeve sealingly slidable inside the throughbore of the valve body;

wherein the sleeve comprises an outer wall, an inner wall, an annular space therebetween, a fluid inlet in the outer wall in fluid communication with the annular space, and a plurality of outlets in the outer wall in fluid communication with the annular space, each one of the plurality of outlets corresponding to a respective one of the plurality of outlets in the valve body;

wherein the sleeve is axially movable from a closed position, in which none of the outlets in the sleeve is aligned with an outlet in the body, to a plurality of valving positions including one valving position in which an outlet in the body is aligned with the corresponding outlet in the sleeve to fluidly connect the reservoir to the first piston of the perforating assembly, and another valving position in which another outlet in the body is aligned with the corresponding outlet in the sleeve to fluidly connect the reservoir to the second piston of the perforating assembly; and wherein the apparatus further comprises a push tube slidably supported in the housing and having first and second ends, the second end sized and positioned to engage the sleeve of the operating valve to cause axial movement thereof.

17. The apparatus of claim 16 wherein the push tube defines a flow passage, wherein the push tube is sealingly slidable on the support stem of the housing, wherein the support stem defines a flow passage continuous with the flow passage of the push tube, wherein the flow passage of the support stem is fluidly connected to the cylinder of the perforating assembly so that the flow path in the piercing member is continuous with the support stem.

18. The apparatus of claim 17 wherein the housing comprises a return flow path inside the housing above the valve body, wherein the housing comprises an outlet connecting the return flow path with the outside of the housing, wherein the push tube includes an opening positioned to be open to the return flow path in the housing when the sleeve is in the closed position and to be sealed by the support stem when the sleeve is in one of the plurality of valving positions, so that when the apparatus is positioned in the tubular structure and the sleeve is in the closed position, fluid can be passed through the push tube, out the opening in the push tube into the return flow path in the housing, through the outlet in the housing to the outside of the housing, and so that when the sleeve is in one of the valving positions, fluid can be passed through the push tube, into the support stem through the perforating assembly and through the piercing member.

19. The apparatus of claim 1 wherein the setting/pack-off assembly comprises:

a back-up plate sized to engage the tubular structure and movable in a first direction from a retracted position in which the back-up plate does not engage the tubular structure to an extended position in which the back-up plate engages the tubular structure;

a packer on the sidewall opposite the back-up plate shaped and positioned to surround the piercing member when the piercing member is in the second position;

a cylinder supported in the housing;

a fluid-driven piston sealingly slidable within the cylinder and dividing the cylinder into a first chamber and a second chamber;

a stem extending between the back-up plate and the piston;

and wherein the pressurized fluid reservoir is fluidly connected to the cylinder so that when the reservoir is filled with pressurized fluid the fluid can drive the piston; and wherein the operating valve is adapted to control the flow of pressurized fluid from the reservoir to the cylinder, wherein the first chamber of the cylinder is fluidly connected to the pressurized fluid reservoir to push the piston in the first direction when the reservoir contains pressurized fluid, and wherein the operating valve controls the flow of fluid from the fluid reservoir to the cylinder of the setting/pack-off assembly.

20. The apparatus of claim 19 wherein the apparatus further comprises a dump chamber adapted to receive fluid, wherein the back-up plate is further defined as movable in a second direction from the extended position to the retracted position, wherein the second chamber of the cylinder is fluidly connected to the pressurized fluid reservoir to push the piston in the second direction when the reservoir contains pressurized fluid, wherein the first chamber of the cylinder is fluidly connected to the dump chamber, wherein the operating valve controls flow of fluid into the second chamber of the back-up plate cylinder to push the piston in the second direction and permits fluid in the first chamber of the back-up plate cylinder to escape to the dump chamber in response to movement of the piston in the second direction.

21. The apparatus of claim 1 wherein the operatin valve comprises:

a valve body having a tubular sidewall defining a longitudinal throughbore, wherein the sidewall comprises an inlet fluidly connected to the pressurized fluid reservoir and an outlet fluidly connected to the perforating assembly;

a sleeve sealingly slidable along the inside of the throughbore of the valve body;

wherein the sleeve comprises an outer wall, an inner wall, an annular space therebetween, a fluid inlet in the outer wall in fluid communication with the annular space, and an outlet in the outer wall in fluid communication with the annular space;

wherein the sleeve is axially movable from a closed position, in which the outlet in the sleeve is not aligned with the outlet in the body, to a valving position in which the outlet in the body is aligned with the outlet in the sleeve; and wherein the apparatus further comprises a push tube slidably supported in the housing and having first and second ends, the second end sized and positioned to engage the sleeve of the valve to cause axial movement thereof to move the sleeve from the closed position to the valving position.

22. A system for withdrawing and injecting fluid through the casing in a subterranean well, the system comprising:

a rotatable and axially movable elongate conduit sized to be received in the casing, the conduit having an end extendable into the casing;

a perforating apparatus comprising:

housing having a first end defining an inlet, the first end being connectable to the end of the conduit so that the conduit is continuous with the inlet of the housing, wherein the housing defines an operating fluid flow path beginning with the inlet and wherein the housing is supportable at a selected position in the casing;

a fluid driven perforating assembly in the housing, the perforating assembly comprising a piercing member supported for movement from a first position within the housing to a second position in which a portion of the piercing member is extendable beyond the housing to perforate the well casing, wherein the piercing member comprises a fluid flow path;

wherein the perforating assembly defines a fluid flow path continuous with the operating fluid flow path through the housing and the fluid flow path in the piercing member so that when the piercing member is in the second position a continuous flow path is formed between the conduit and the portion of the piercing member that is extendable through the well casing;

a fluid driven setting/pack-off assembly adapted to releasably secure the housing at the selected position in the well casing and to provide a releasable seal between the inside of the well casing outside the apparatus and the fluid flow paths in the housing, the piercing member and the perforating assembly of the apparatus;

a pressurized fluid reservoir contained in the housing and operatively connected to the seal assembly and the perforating assembly; and an operating valve adapted to control fluid flow between the fluid reservoir and the seal assembly and between the fluid reservoir and the perforating assembly, the operating valve operable Independent of fluid flow in the elongate conduit.

23. The system of claim 22 wherein the perforating apparatus further comprises a releasable lock assembly operable by rotation of the elongate conduit between a locked position, in which the elongate conduit is fixed relative to the housing, and an unlocked position, in which the elongate conduit is axially movable relative to the housing.

24. The system of claim 23 wherein the perforating assembly comprises a cylinder, wherein the piercing member is slidably supported in the cylinder, wherein the perforating assembly further comprises a first fluid-driven piston in the cylinder for driving the movement of the piercing member, wherein the pressurized fluid reservoir is fluidly connected to the cylinder so that when the reservoir is filled with pressurized fluid the fluid can drive the piston, and wherein the operating valve adapted to control the flow of pressurized fluid from the reservoir to the cylinder.

25. The system of claim 24 wherein the setting/pack-off assembly comprises:

a back-up plate sized to engage the well casing and movable in a first direction from a retracted position in which the back-up plate does not engage the well casing to an extended position in which the back-up plate engages the well casing;

a packer on the sidewall opposite the back-up plate shaped and positioned to surround the piercing member when the piercing member is in the second position;

a cylinder supported in the housing;

a fluid-driven piston sealingly slidable within the cylinder and dividing the cylinder into a first chamber and a second chamber;

a stem extending between the back-up plate and piston and;

wherein the first chamber of the cylinder is fluidly connected to the pressurized fluid reservoir to push the piston in the first direction when the reservoir contains pressurized fluid; and wherein the operating valve controls the flow of fluid from the fluid reservoir to the cylinder of the setting/pack-off assembly.

26. The system of claim 25 wherein the housing of the perforating apparatus is cylindrical defining a side wall, wherein the piercing member extends radially through the side wall, wherein the back-up plate extends radially from the side wall of the housing and is positioned to move opposingly to the piercing member.

27. The system of claim 25 wherein the piercing member comprises a base and is movable from the second position to a third position in which the base is extendable through the perforation in the well casing to occlude the perforation, wherein first piston of the perforating assembly comprises a recess, wherein the perforating assembly further comprises a second fluid-driven piston slidably receivable in the recess for driving movement of the piercing member from the second position to the third position, wherein the recess is fluidly connected to the pressurized fluid reservoir so that when the reservoir is filled with pressurized fluid the fluid can drive the movement of the second piston, and wherein the operating valve is adapted to control the flow of fluid from the reservoir to the recess.

28. The system of claim 27 wherein the operating valve comprises:

a valve body having a tubular sidewall defining a longitudinal throughbore, wherein the sidewall comprises a first inlet fluidly connected to the pressurized fluid reservoir, and a plurality of longitudinally spaced-apart outlets, a first one of the plurality of outlets fluidly connected to the first chamber of the cylinder of the setting/pack-off assembly to drive the piston in the first direction, a second one of the plurality of outlets fluidly connected to the cylinder of the perforating assembly to drive the movement of the first piston, a third one of the plurality of outlets fluidly connected to the cylinder of the perforating assembly to drive the movement of the second piston;

a sleeve sealingly slidable along the inside of the throughbore of the valve body;

wherein the sleeve comprises an outer wall, an inner wall, an annular space therebetween, a fluid inlet in the outer wall in fluid communication with the annular space, and a plurality of outlets in the outer wall in fluid communication with the annular space, each one of the plurality of outlets corresponding to a respective one of the plurality of outlets in the valve body;

wherein the sleeve is axially movable from a closed position, in which none of the outlets in the sleeve is aligned with an outlet in the body, to a plurality of valving positions including a first valving position in which the first outlet in the body is aligned with the corresponding outlet in the sleeve, a second valving position in which the second outlet in the body is aligned with the corresponding outlet in the sleeve, and a third valving position in which the third outlet in the body is aligned with the corresponding outlet in the sleeve; and wherein the perforating apparatus further comprises a push tube slidably supported in the housing and having first and second ends, the first end connectable to the elongate conduit for axial movement therewith when the lock assembly is in the unlocked position, the second end sized and positioned to engage the sleeve of the valve to cause axial movement thereof to move the sleeve from the closed position to the plurality of valving positions.

29. The system of claim 28 wherein the perforating apparatus further comprises a dump chamber adapted to receive fluid, wherein the back-up plate is further defined as movable in a second direction from the extended position to the retracted position, wherein the plurality of outlets in the valve body includes a fourth outlet fluidly connected to the second chamber of the cylinder of the setting/pack-off assembly to drive the movement of the piston in the second direction, wherein the valve body includes a second inlet fluidly connected to the first chamber of the cylinder of the setting/pack-off assembly, wherein the valve body includes a fifth outlet fluidly connected to the dump chamber, wherein the sleeve of the operating valve comprises a pass-through channel, and wherein the sleeve is movable to a fourth valving position in which the fourth outlet in the body is aligned with the corresponding outlet in the sleeve to direct pressurized fluid into the second chamber of the back-up plate cylinder and in which the pass-through channel in the sleeve connects the second inlet of the valve body with the fifth outlet to permit fluid in the first chamber of the back-up plate cylinder to escape to the dump chamber.

30. The system of claim 29 wherein the housing comprises a support stem fixed relative to the housing and receivable inside the sleeve of the valve sleeve, wherein the push tube defines a flow passage continuous with the elongate conduit, wherein the push tube is sealingly slidable on the support stem, wherein the support stem defines a flow passage continuous with the flow passage of the push tube, wherein the flow passage of the support stem is fluidly connected to the cylinder of the perforating assembly so that the flow path in the piercing member is continuous with the support stem.

31. The system of claim 30 wherein the return flow path comprises a second flow path inside the housing above the valve body, wherein the housing comprises an outlet connecting the return flow path with the outside of the housing, wherein the push tube serves as a flow valve and includes an opening positioned to be open to the return flow path in the housing when the sleeve is in the closed position and to be sealed by the support stem when the sleeve is in one of the plurality of valving positions, so that when the apparatus is connected to the elongate outlet and positioned in the well casino fluid can be passed through the elongate conduit, through the push tube, through the opening in the push tube into the return flow path in the housing, through the outlet in the housing to the outside of the housing.

32. The system of claim 22 further comprising a friction member on the housing sized to frictionally engage the well casing as the apparatus is pushed therethrough.

33. The system of claim 32 wherein the friction member is a bow-spring centralizer.

34. The system of claim 22 wherein the perforating assembly comprises a cylinder, wherein the piercing member is slidably supported in the cylinder, wherein the perforating assembly further comprises a first fluid-driven piston in the cylinder for driving the movement of the piercing member, wherein the pressurized fluid reservoir is fluidly connected to the cylinder so that when the reservoir is filled with pressurized fluid the fluid can drive the piston, and wherein the operating valve is adapted to control the flow of pressurized fluid from the reservoir to the cylinder.

35. The system of claim 34 wherein the piercing member comprises a base, wherein the piercing member is movable from the second position to a third position in which the base is extendable through the perforation to occlude the perforation, wherein first piston comprises a recess, wherein the perforating assembly further comprises a second fluid-driven piston slidably receivable in the recess for driving movement of the piercing member from the second position to the third position, wherein the recess is fluidly connected to the pressurized fluid reservoir so that when the reservoir is filled with pressurized fluid the fluid can drive the movement of the second piston, and wherein the operating valve is adapted to control the flow of fluid from the reservoir to the recess.

36. The system of claim 35 wherein the operating valve comprises:

a valve body having a tubular sidewall defining a longitudinal throughbore, wherein the sidewall comprises a first inlet fluidly connected to the pressurized fluid reservoir, and a plurality of longitudinally spaced-apart outlets, one of the plurality of outlets fluidly connected to the cylinder of the perforating assembly to drive the movement of the first piston, another one of the plurality of outlets fluidly connected to the cylinder of the perforating assembly to drive the movement of the second piston;

a sleeve sealingly slidable inside the throughbore of the valve body;

wherein the sleeve comprises an outer wall, an inner wall, an annular space therebetween, a fluid inlet in the outer wall in fluid communication with the annular space, and a plurality of outlets in the outer wall in fluid communication with the annular space, each one of the plurality of outlets corresponding to a respective one of the plurality of outlets in the valve body;

wherein the sleeve is axially movable from a closed position, in which none of the outlets in the sleeve is aligned with an outlet in the body, to a plurality of valving positions including one valving position in which an outlet in the body is aligned with the corresponding outlet in the sleeve to fluidly connect the reservoir to the first piston of the perforating assembly, and another valving position in which another outlet in the body is aligned with the corresponding outlet in the sleeve to fluidly connect the reservoir to the second piston of the perforating assembly; and wherein the perforating apparatus further comprises a push tube slidably supported in the housing and having first and second ends, the second end sized and positioned to engage the sleeve of the operating valve to cause axial movement thereof.

37. The system of claim 36 wherein apparatus further comprises a support stem fixed relative to the housing, wherein the push tube defines a flow passage, wherein the push tube is sealingly slidable on the support stem, wherein the support stem defines a flow passage continuous with the flow passage of the push tube, wherein the flow passage of the support stem is fluidly connected to the cylinder of the perforating assembly so that the flow path in the piercing member is continuous with the support stem.

38. The system of claim 37 wherein the housing comprises a return flow path inside the housing above the valve body, wherein the housing comprises an outlet connecting the return flow path with the outside of the housing, wherein the push tube serves as a flow valve and includes an opening positioned to be open to the return flow path in the housing when the sleeve is in the closed position and to be sealed by the support stem when the sleeve is in one of the plurality of valving positions, so that when the apparatus is positioned in the well casing and the sleeve is in the closed position, fluid can be passed through the push tube, out the opening in the push tube into the return flow path in the housing, through the outlet in the housing to the outside of the housing and up through the elongate conduit, and so that when the sleeve is in one of the valving positions, fluid can be passed through the push tube, into the stem through the perforating assembly and through the piercing member through the perforation in the well casing.

39. The system of claim 22 wherein the setting/pack-off assembly comprises:

a back-up plate sized to engage the well casing and movable in a first direction from a retracted position in which the back-up plate does not engage the well casing to an extended position in which the back-up plate engages the well casing;

a packer on the sidewall opposite the back-up plate shaped and positioned to surround the piercing member when the piercing member is in the second position;

a cylinder supported in the housing;

a fluid-driven piston sealingly slidable within the cylinder and dividing the cylinder into a first chamber and a second chamber;

a stem extending between the back-up plate and the piston; and wherein the pressurized fluid reservoir is fluidly connected to the cylinder so that when the reservoir is filled with pressurized fluid the fluid can drive the piston; and wherein the operating valve is adapted to control the flow of pressurized fluid from the reservoir to the cylinder, wherein the first chamber of the cylinder is fluidly connected to the pressurized fluid reservoir to push the piston in the first direction when the reservoir contains pressurized fluid, and wherein the operating valve controls the flow of fluid from the fluid reservoir to the cylinder of the setting/pack-off assembly.

40. The system of claim 39 wherein the perforating apparatus further comprises a dump chamber adapted to receive fluid, wherein the back-up plate is further defined as movable in a second direction from the extended position to the retracted position, wherein the second chamber of the cylinder is fluidly connected to the pressurized fluid reservoir to push the piston in the second direction when the reservoir contains pressurized fluid, wherein the first chamber of the cylinder is fluidly connected to the dump chamber, wherein the operating valve controls flow of fluid into the second chamber of the back-up plate cylinder to push the piston in the second direction and permits fluid in the first chamber of the back-up plate cylinder to escape to the dump chamber in response to movement of the piston in the second direction.

41. The system of claim 22 wherein the operating valve comprises:

a valve body having a tubular sidewall defining a longitudinal throughbore, wherein the sidewall comprises an inlet fluidly connected to the pressurized fluid reservoir and an outlet fluidly connected to the perforating assembly;

a sleeve sealingly slidable inside the throughbore of the valve body;

wherein the sleeve comprises an outer wall, an inner wall, an annular space therebetween, a fluid inlet in the outer wall in fluid communication with the annular space, and an outlet in the outer wall in fluid communication with the annular space;

wherein the sleeve is axially movable from a closed position, in which the outlet in the sleeve is not aligned with the outlet in the body, to a valving position in which the outlet in the body is aligned with the outlet in the sleeve; and wherein the perforating apparatus further comprises a push tube slidably supported in the housing and having first and second ends, the second end sized and positioned to engage the sleeve of the valve to cause axial movement thereof to move the sleeve from the closed position to the valving position.

42. An apparatus for perforating a tubular structure, the apparatus comprising:

a housing having an inlet and an outlet;

a fluid-driven piercing member supported for movement from a first position within the housing to a second position in which a portion of the piercing member is extendable through the tubular structure, wherein the piercing member comprises a fluid flow path;

wherein the housing defines an operating fluid flow path beginning with the inlet and connectable alternately with the fluid flow path in the piercing member and the outlet of the housing;

a pressurized fluid reservoir fluidly connected to the fluid driven piercing member;

a first valve adapted to control flow of fluid between the pressurized fluid reservoir and the piercing member to drive the movement of the piercing member from the first position to the second position; and a second valve adapted to control flow of fluid between the operating flow path in the housing and to either of the flow path in the piercing member and the outlet of the housing.

43. The apparatus of claim 42 wherein the inlet of the apparatus is connectable to an elongate conduit extendable through the tubular structure and wherein the first valve is operable by axial movement of the conduit when it is connected to the apparatus.

44. The apparatus of claim 43 wherein the second valve is operable by axial movement of the conduit when it is connected to the apparatus.

45. The apparatus of claim 42 wherein the inlet of the apparatus is connectable to an elongate conduit extendable through the tubular structure and wherein the apparatus further comprises a releasable lock assembly operable by rotation of the elongate conduit between a locked position, in which the elongate conduit is fixed relative to the housing, and an unlocked position, in which the elongate conduit is axially movable relative to the housing.

46. The apparatus of claim 45 wherein the first valve is operable by axial movement of the conduit when it is connected to the apparatus.

47. The apparatus of claim 45 wherein the second valve is operable by axial movement of the conduit when it is connected to the apparatus.

48. The apparatus of claim 47 wherein the first valve comprises:

a valve body having a tubular sidewall defining a longitudinal throughbore, wherein the sidewall comprises a first inlet fluidly connected to the pressurized fluid reservoir, and an outlet fluidly connected to the piercing member;

a stem supported non-movingly and longitudinally within the throughbore of the valve body;

a sleeve sealingly slidable along the outside of the stem and inside the throughbore of the valve body;

wherein the sleeve comprises an outer wall, an inner wall, an annular space therebetween, a fluid inlet in the outer wall in fluid communication with the annular space, and an outlet in the outer wall in fluid communication with the annular space;

wherein the sleeve is axially movable from a closed position, in which the outlet in the sleeve is not aligned with the outlet in the body, to a valving position in which the outlet in the body is aligned with the outlet in the sleeve, and wherein the apparatus further comprises a push tube slidably supported in the housing and having first and second ends, the first end connectable to the elongate conduit for axial movement therewith when the lock assembly is in the unlocked position, the second end sized and positioned to engage the sleeve of the valve to cause axial movement thereof to move the sleeve from the closed position to the valving position.

49. The apparatus of claim 48 wherein the housing comprises a second flow path inside the housing above the valve body, wherein the outlet in the housing connects the second flow path with the outside of the housing, wherein the second valve comprises an opening in the push tube positioned to be open to the second flow path in the housing when the sleeve is in the closed position and to be sealed by the stem when the sleeve is in the valving position, so that when the apparatus is connected to the elongate outlet and positioned in the tubular structure fluid can be passed through the elongate conduit alternately out the outlet in the housing to the outside of the housing when the sleeve is in the closed position or through the piercing member out the perforation when the sleeve is in the valving position.

50. An apparatus for use with an elongate conduit for withdrawing and injecting fluid through the wall of a tubular structure, the apparatus comprising:

a housing;

a fluid driven piercing member supported in the housing for movement from a first position within the housing to a second position in which a portion of the piercing member is extendable through the tubular structure;

a fluid driven-setting/pack-off assembly adapted to secure the apparatus temporarily at a selected position in the tubular structure, the setting/pack-off assembly comprising:

a back-up plate sized to engage the tubular structure and movable in a first direction from a retracted position in which the back-up plate does not engage the tubular structure to an extended position in which the back-up plate engages the tubular structure, and in a second direction from the extended position to the retracted position; and a packer on the sidewall opposite the back-up plate shaped and positioned to surround the piercing member when the piercing member is in the second position, the packer adapted to provide a seal between the inside of the tubular structure outside the apparatus and the piercing member;

a cylinder supported in the housing;

a fluid-driven piston sealingly slidable within the cylinder and dividing the cylinder into a first chamber and a second chamber;

a stem extending between the back-up plate and the piston;

a pressurized fluid reservoir fluidly connected to the setting/pack-off assembly;

a operating valve adapted to control the flow of fluid from the fluid reservoir to the setting/pack-off assembly and the piercing member; and wherein the apparatus further comprises a dump chamber adapted to receive fluid, wherein the first chamber of the cylinder of the setting/pack-off assembly is fluidly connected to the pressurized fluid reservoir to drive movement of the back-up plate in the first direction, wherein the second chamber of the cylinder of the setting/pack-off assembly is fluidly connected to the pressurized fluid reservoir to drive movement of the back-up plate in the second direction, and wherein the second chamber is fluidly connected to the dump chamber to receive fluid in response to movement of the back-up plate in the second direction, wherein the operating valve controls flow of fluid from the pressurized fluid reservoir to the first and second chambers and from the second chamber to the dump chamber.

* * * * *